US011217123B2

(12) United States Patent
Pasternak et al.

(10) Patent No.: US 11,217,123 B2
(45) Date of Patent: Jan. 4, 2022

(54) DISPLAY CARD HOLDER ASSEMBLY AND METHODS

(71) Applicant: Randall Marketing International Inc., Thiensville, WI (US)

(72) Inventors: M. Randall Pasternak, Thiensville, WI (US); Mark Donald Schaefer, Oconomowoc, WI (US)

(73) Assignee: RANDALL MARKETING INTERNATIONAL INC., Thiensville, WI (US)

( * ) Notice: Subject to any disclaimer, the term of this patent is extended or adjusted under 35 U.S.C. 154(b) by 8 days.

(21) Appl. No.: 16/940,484

(22) Filed: Jul. 28, 2020

(65) Prior Publication Data

US 2021/0043118 A1 Feb. 11, 2021

Related U.S. Application Data

(60) Provisional application No. 62/883,868, filed on Aug. 7, 2019.

(51) Int. Cl.

| | |
|---|---|
| ***G09F 7/18*** | (2006.01) |
| ***G09F 7/10*** | (2006.01) |
| ***G09F 21/04*** | (2006.01) |

(52) U.S. Cl.

CPC ..... *G09F 7/18* (2013.01); *G09F 7/10* (2013.01); *G09F 21/04* (2013.01); *G09F 2007/1865* (2013.01)

(58) Field of Classification Search

CPC ... G09F 7/18; G09F 7/10; G09F 21/04; G09F 2007/1865

See application file for complete search history.

(56) References Cited

U.S. PATENT DOCUMENTS

| | | | |
|---|---|---|---|
| 3,025,093 | A | 3/1962 | Millman |
| 3,514,820 | A | 6/1970 | Rogg |
| 3,665,629 | A | 5/1972 | Shore |
| 3,909,888 | A | 10/1975 | Funston et al. |
| 3,958,788 | A | 5/1976 | Feibelman |
| 4,089,116 | A | 5/1978 | Bearinger |

(Continued)

FOREIGN PATENT DOCUMENTS

| | | |
|---|---|---|
| JP | 2000356948 | 12/2000 |
| WO | WO1989/010605 | 11/1989 |

*Primary Examiner* — Gary C Hoge

(74) *Attorney, Agent, or Firm* — Ryan Kromholz & Manion, S.C.

(57) ABSTRACT

A device according to the present invention provides for an improved display card holder assembly and methods of operation. Wherein the improved assembly provides for a sleeve, collar and holder in removable communication to increase stability and reduce vibration of the card holder assembly. The assembly providing for a first embodiment comprising a holder comprising a button mechanism and nodes, and a sleeve comprising tabs and extensions, for increased stability. The assembly providing for a second embodiment comprising a holder comprising a lever mechanism, and at least one of an over-mold and assembled sleeve/collar combination, for increased stability. The assembly providing for a third embodiment comprising a holder comprising a hinge mechanism for increased stability. The invention further providing for methods of operation of the embodiments.

19 Claims, 12 Drawing Sheets

(56) References Cited

U.S. PATENT DOCUMENTS

| | | | | |
|---|---|---|---|---|
| 4,449,310 | A | 5/1984 | Kline | |
| 4,498,827 | A | 2/1985 | Mair | |
| 4,645,105 | A | 2/1987 | Plumbridge | |
| 4,699,303 | A | 10/1987 | Kline | |
| D295,919 | S | 5/1988 | Makio | |
| 5,020,196 | A | 6/1991 | Panach et al. | |
| 5,022,689 | A | 6/1991 | Perdue et al. | |
| 5,134,757 | A | 8/1992 | Johnson | |
| 5,184,375 | A | 2/1993 | Hoyt | |
| 5,489,121 | A | 2/1996 | Mohr | |
| 5,676,400 | A | 10/1997 | Lin | |
| 5,697,176 | A | 12/1997 | Kuni | |
| 5,996,264 | A | 12/1999 | Nagel | |
| 6,003,259 | A | 12/1999 | Krapf et al. | |
| 6,182,938 | B1 * | 2/2001 | Wright | A47G 1/21 211/45 |
| 6,298,590 | B1 * | 10/2001 | Levinson | G09F 21/04 211/89.01 |
| 6,336,765 | B1 | 1/2002 | Watanabe | |
| 6,357,090 | B1 | 3/2002 | Murai | |
| 6,484,429 | B1 | 11/2002 | Przylucki | |
| 6,658,777 | B2 | 12/2003 | Dundorf | |
| 6,678,977 | B1 | 1/2004 | Sherman | |
| 6,688,027 | B2 | 2/2004 | Fink | |
| 7,103,997 | B2 | 9/2006 | Ruffino | |
| 7,121,030 | B2 | 10/2006 | Schneider | |
| 7,159,347 | B1 | 1/2007 | Ngan | |
| 7,207,129 | B2 | 4/2007 | Buchanan et al. | |
| D554,561 | S | 11/2007 | DiCarlo | |
| 7,293,382 | B2 | 11/2007 | Polvere et al. | |
| 7,487,611 | B2 | 2/2009 | Robb | |
| 7,743,541 | B2 | 6/2010 | Suciu et al. | |
| 7,823,311 | B2 | 11/2010 | Pitcher et al. | |
| 8,863,419 | B1 * | 10/2014 | Pace | G09F 15/0018 40/617 |
| 9,015,973 | B2 * | 4/2015 | Pasternak | G09F 1/103 40/373 |
| 10,176,732 | B1 | 1/2019 | Hinkens | |
| 2002/0035798 | A1 | 3/2002 | Gray | |
| 2004/0128895 | A1 | 7/2004 | Trudel | |
| 2004/0163295 | A1 | 8/2004 | Fontana | |
| 2005/0086843 | A1 * | 4/2005 | Buchanan | G09F 21/04 40/611.05 |
| 2007/0144048 | A1 | 6/2007 | Kodde et al. | |
| 2012/0211534 | A1 | 8/2012 | Hake | |
| 2014/0165436 | A1 * | 6/2014 | Ruybal | G09F 1/103 40/606.03 |
| 2014/0259819 | A1 * | 9/2014 | Dalpra | G09F 21/04 40/204 |
| 2015/0075041 | A1 * | 3/2015 | Pasternak | G09F 3/20 40/124.06 |
| 2016/0035256 | A1 * | 2/2016 | Trinh | G09F 23/06 40/611.01 |

* cited by examiner

DISPLAY CARD HOLDER ASSEMBLY AND METHODS

RELATED APPLICATIONS

This application claims the benefit of Provisional Application Ser. No. 62/853,866 filed 7 Aug. 2019.

BACKGROUND OF THE INVENTION

The present invention relates to an improved device for removably holding a disposable card, such as an information card or score card, and methods of operation of the assembly. Cards such as those contemplated for use with the present invention are commonly used in numerous settings, such as during sporting events during which it is desirable to enable a user to easily mark the card, while also enabling handy storage thereof. For example in the game of golf, carts may be readily identified by information cards attached thereto. Cards may also be used by players to record individual scores along with those of playing companions. In golf, cards such as these also include information about the course being played, such as layout, distances and par. Cards such as these should be readily accessible and removable, for verbiage altering, modification, or replacement while also being protected from the elements, yet adequately secured.

The device of the present invention may also be used in other applications. For example, the device may be used in a store or other point of purchase location to hold a card having indicia of the products or services being offered for sale. As another non-limiting example, the device may be used on a machine and include job or safety specifications. Due to the nature of the invention, the device may also find application in a setting where a first, set of information is printed on one side of the card and a second set of information is printed on the opposite side of the card. The desired information may be displayed depending upon the orientation of the selected card side relative to the invention.

It is observed the prior art has sought to provide for a card holding assembly for holding a disposable card on a vehicle, a cart or a machine. However, the prior art has had to address continued vibration of the assembly while the vehicle on which the assembly is mounted is in operation.

A need exists for a card holding assembly having a collar and mounting holder which reduces vibration of the card holding assembly.

A need exists for a card holding assembly having a collar designed to reduce the transfer of vibration thru the card holding assembly.

A need exists for a card holding assembly having mounting holder designed to reduce the transfer of vibration thru the card holding assembly.

SUMMARY OF THE INVENTION

The present invention relates to an improved device for removably holding a disposable card, such as an information card or score card, and methods of operation of the assembly. The present invention is directed to a novel card holding assembly having a card retaining sleeve, a holder and a collar. The assembly may be temporarily but securely affixed to a supporting structure, such as, by non-limiting example, a golf cart. A first embodiment of the card holding assembly comprises a first embodiment of the card retaining sleeve, a first embodiment of the collar, and a first embodiment of the holder. Wherein the card retaining sleeve, the collar and the holder are in fixed and removable communication. The fixed communication provides for reduced vibration of the card holding assembly while the vehicle on which the card holding assembly is attached is in operation. The card retaining sleeve preferably includes a sleeve body and a top portion. The top portion extends laterally from the sleeve body to form a preferred top marginal edge profile. The profile is adapted for engagement with the collar. The profile is adapted for further engagement in the holder. A top marginal edge portion includes a cut out edge portion which extends inwardly relative to the side marginal edges. The cut out edge portion is further shaped with tabs for engagement with the sleeve holder. The tabs provide for further stability of the assembly when in operation with a vehicle. A top marginal edge ridge extends laterally from the top portion, specifically the top marginal edge portion. The top marginal edge ridge contacts a holder cavity top of the holder, when the sleeve and collar are combined and inserted in the holder, to provide for stability and reduced movement of the card holding assembly. A plurality of thru holes 58 extend thru the top portion, preferably three thru holes, along at least substantially the holder length.

The collar comprising two collar halves. The collar halves removably connect to the sleeve. At least one collar support post extending laterally from the collar provides for removable communication with the holder. Wherein communication of the collar post and the holder provides for further stability of the assembly.

The holder comprising a cavity for receipt of the profile of the sleeve. The holder preferably comprising at least one ridge within the cavity. Wherein the at least one ridge provides for frictional communication with the sleeve, providing further stability of the assembly.

The holder of the first embodiment of the card holding assembly comprising a button mechanism for retention and release or the sleeve. The holder provided for in a first embodiment and second embodiment for various attachment configurations to a vehicle. The holder having at least one node extending from the holder to provide for reduced vibration of the assembly when the assembly is in operation on a vehicle.

A method of operation of the first embodiment of the card holding assembly is provided, specifically attaching, holding an release the removable communication between the sleeve and holder.

A second embodiment of the card holding assembly provides for at least one of a second embodiment of the card retaining sleeve and a third embodiment of the card retaining sleeve. The second embodiment of the card holding assembly further provides at least one of a second embodiment of the collar and a second embodiment of the collar. The second embodiment of the card holding assembly further provides at least one of a third embodiment of the holder and a fourth embodiment of the holder. The second embodiment of the card holding assembly provides for the collar as an overmold unit and molded over at least part of the sleeve to form a sleeve/collar combination first embodiment. Where in the sleeve/collar combination is in removable communication with the holder. The second embodiment of the card holding assembly provides for the collar as to halves in removable communication with the sleeve to form a sleeve/collar combination first embodiment. Where in the sleeve/collar combination is in removable communication with the holder. The sleeve/collar combination providing further stability to the assembly.

The holder of the second embodiment of the assembly comprising a lever mechanism. Wherein the lever mechanism provides for increased stability of the assembly. The holder preferably providing for a flange connection to the vehicle. Wherein the flange connection provides for increased stability of the assembly. Alternatively, the holder providing for a single surface connection between the holder and vehicle.

A method of operation of the second embodiment of the card holding assembly is provided, specifically attaching, holding and release the removable communication between the sleeve/collar combination and holder employing a lever mechanism.

A third embodiment of the card holding assembly is described. The third embodiment of the card holding assembly incorporates at least one element of the second embodiment of the card holding assembly. The third embodiment of the card holding assembly further incorporates a fifth embodiment of the holder. The fifth embodiment of the holder comprises a hinge mechanism for removable communication between the sleeve/collar combination and the holder. Wherein the hinge mechanism provides for increased stability of the assembly. The holder preferably providing for a flange connection to the vehicle. Wherein the flange connection provides for increased stability of the assembly. Alternatively, the holder providing for a single surface connection between the holder and vehicle.

The card holder assembly for removable attachment to a vehicle may comprise: a card retaining sleeve having at least one closed edge; a collar removably coupled with the card retaining sleeve; and a holder having at least one opening for receiving at least one of the card retaining sleeve and the collar. The card retaining sleeve further comprises a back panel and a top edge, with the top edge having a laterally extending portion. The collar is removably coupled with at least one of the laterally extending portion and the back panel. The collar comprises two halves removably attached about the card retaining sleeve. The at least one opening defines at least one post cavity and at least one central cavity. The collar has at least one collar post slidably positionable in the at least one post cavity. The holder is mountable to the vehicle by at least one of at least one thru hole along a holder length and a mounting groove extendable at least substantially the holder length. The collar has at least one substantially vertical rib in frictional communication with the holder. The holder has a locking mechanism for releasable engagement with at least one of the card retaining sleeve and the collar.

A method of operation of the third embodiment of the card holding assembly is provided, specifically attaching, holding and release the removable communication between the sleeve/collar combination and holder employing a hinge mechanism. A method of operating a card holder assembly for removable attachment to a vehicle comprising: the card holder assembly comprising: a card retaining sleeve having at least one closed edge; a holder having at least one opening for receiving at least one of the card retaining sleeve and the collar removably coupled to the card retaining sleeve; the holder has a locking mechanism for releasable engagement with at least one of the card retaining sleeve and the collar; actuating the locking mechanism; and releasably communicating the locking mechanism with at least one of the card retaining sleeve and the collar. The method of operating a card holder assembly further comprises actuating a locking mechanism spring, wherein the spring is operable substantially orthogonal to the card retaining sleeve.

An intended benefit of the card holding assembly of the present invention is to provide for a collar and mounting holder which reduces vibration of the card holding assembly.

An intended benefit of the card holding assembly of the present invention is to provide for a collar designed to reduce the transfer of vibration thru the card holding assembly.

An intended benefit of the card holding assembly of the present invention is to provide for a mounting holder designed to reduce the transfer of vibration thru the card holding assembly.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
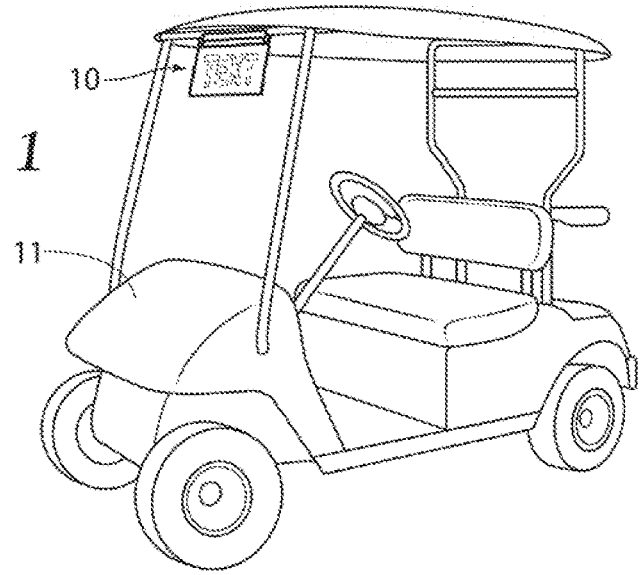
FIG. 1 is a perspective view of a vehicle providing for a card holding assembly of the present invention.
Figure 2:
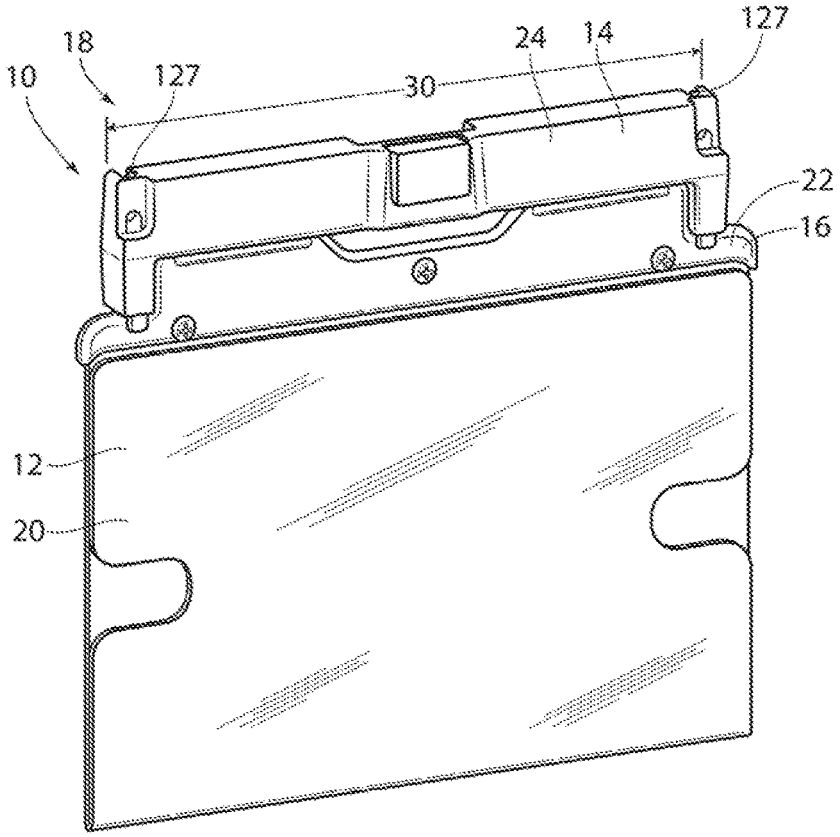
FIG. 2 is a perspective view of a first embodiment of the card holding assembly of the present invention.
Figure 3:
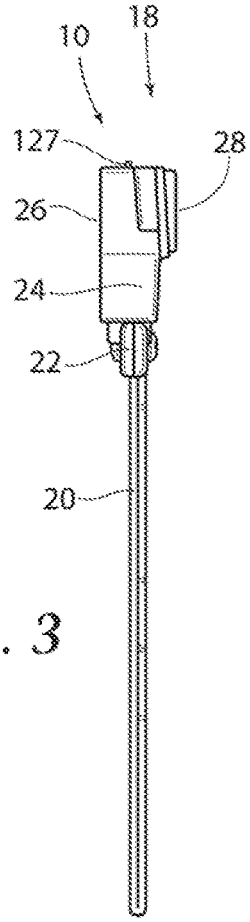
FIG. 3 is a side view of the first embodiment of the card holding assembly of the present invention.

The present invention is directed to a novel card holding assembly 10 having a card retaining sleeve 12, a holder 14 and a collar 16 and methods of operation of the assembly 10. As illustrated in FIG. 1, the assembly 10 may be temporarily but securely affixed to a supporting structure, such as, by non-limiting example, the golf cart 11 seen in FIG. 1. With attention to FIGS. 2 to 10, a first embodiment of the card holding assembly 18 is illustrated. As illustrated in FIG. 2, the first embodiment of the card holding assembly 18 comprises a first embodiment of the card retaining sleeve 20, a first embodiment of the collar 22, and a first embodiment of the holder 24. Wherein the card retaining sleeve 20, the collar 22 and the holder 24 are in fixed and removable communication. The fixed communication provides for reduced vibration of the card holding assembly 18 while the vehicle 11 on which the card holding assembly 18 is attached is in operation. As illustrated in FIGS. 2 and 3, the holder 24 comprises a holder mounting side 26 and an opposite holder operational side 28, extending a holder length 30.

Figure 4:
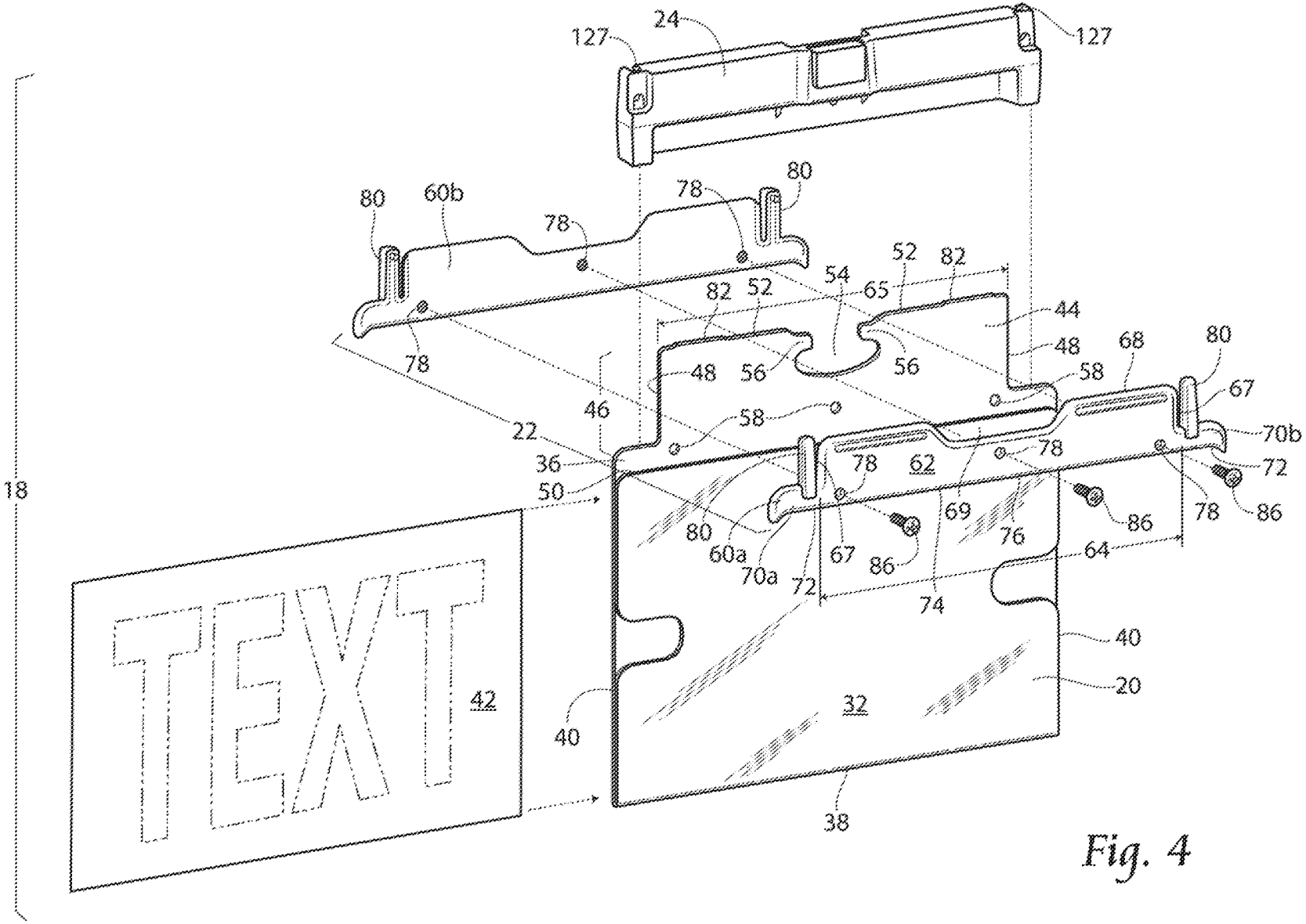
FIG. 4 is an exploded view of the first embodiment of the card holding assembly of the present invention.

As illustrated in FIG. 4, the card retaining sleeve 20 preferably includes a sleeve body 32 having a front panel 34, a back panel 36, and at least one closed edge 38. Wherein the front panel 34 and the back panel 36 define the sleeve body 32. The retaining sleeve 20 further includes two opposed side edges 40, at least one side edge 40 being open to permit a card member 42 passage into the sleeve body 32. The card retaining sleeve 20 further includes a top portion 44, oppositely disposed from the closed edge 33. As shown, the top portion 44 extends laterally from the sleeve body 32 to form a preferred top marginal edge profile 46. The profile 46 is adapted for engagement with the collar 22. The profile 46 is adapted for further engagement in the holder 24. A preferred top marginal edge profile 46 includes two opposed side marginal edge portions 48 extending laterally from the sleeve body 32 and a bottom edge portion 50 attached to the sleeve body 32. A top marginal edge portion 52 intersects with the opposed side marginal edges 48 and further includes a cut out edge portion 54 which extends inwardly relative to the side marginal edges 48. The cut out edge portion 54 is further shaped with tabs 56 for engagement with the sleeve holder 24. A top marginal edge ridge 82 extends laterally from the top portion 44, specifically the top marginal edge portion 52. The top marginal edge ridge 82 contacts a holder cavity top 90 of the holder 24, when the sleeve 20 and collar 22 are combined and inserted in the holder 24, to provide for stability and reduced movement of the card holding assembly 18. A plurality of thru holes 58 extend thru the top portion 44, preferably three thru holes, along at least substantially the holder length 30.

The collar 22 comprising two collar halves (60*a*, 60*b*). Each collar half (60*a*, 60*b*) having a collar body 62 having a collar body length 64 at least greater than a top portion length 65 and defined by oppositely opposed collar side edges 67. A top collar marginal edge portion 68 intersects with the opposed collar side edges 67 and further includes a collar cut out edge portion 69 which extends inwardly relative to the side marginal edges 67. Wherein the collar cut out edge portion 69 complements the cut out edge portion 54 when the card retaining sleeve 20 and collar halves are removable combined (60*a*, 60*b*). A collar arm (70*a*, 70*b*) extends laterally from each side marginal edge 67. Wherein a collar arm base 72 of each collar in combination with a collar body base 74, opposite the top collar marginal edge portion 68, provide for a collar base edge 76. The collar base edge 76 complements the bottom edge portion 50.

A plurality of collar thru holes 78 extend thru the collar halves (60*a*, 60*b*). At least one collar thru hole of the first collar half 60*a* is in line with at least one thru hole 58 of the sleeve 20 and at least one thru hole of the second collar half 60*b*, wherein the sleeve 20 is positioned between the first collar half 60*a* and the second cellar half 60*b*. At least one of a screw, rivet and pin 86 is in removable communication with the combination of the thru hole of the first collar half 60*a*, the thru hole 58 of the sleeve 20 and the thru hole of the second collar half 60*b* in order to removably connect the collar halves (60*a*, 60*b*) to the sleeve 20.

A collar support post 80 half extends from each collar arm (70*a*, 70*b*) opposite the collar base edge 76 and laterally with respect to the collar body 62. The collar support post half 80 of the first collar half 60*a* and the collar support post half 80 of the second collar half 60*b* are in removable communication when the collar halves (60*a*, 60*b*) and sleeve 20 are in removable communication.

Figure 5A:
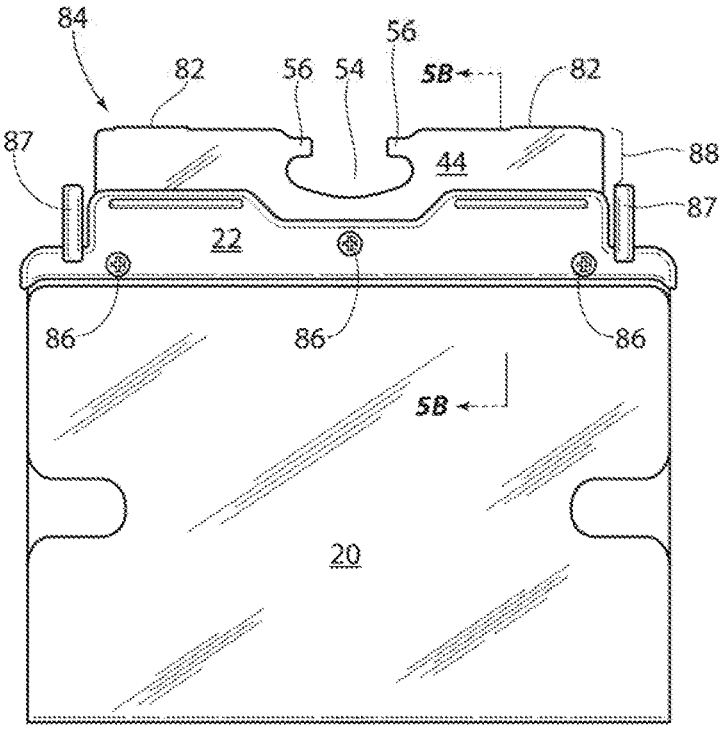
FIG. 5A is a front view of a first embodiment a card retaining sleeve of the present invention and a first embodiment of a collar of the present invention in communication.
Figure 5B:
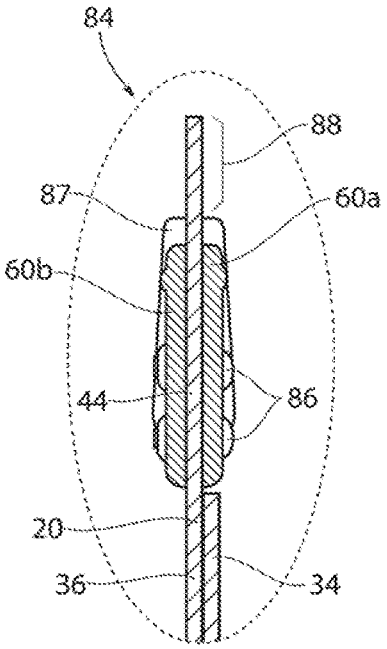
FIG. 5B is a cross-sectional view of the first embodiment the card retaining sleeve of the present invention and the first embodiment of the collar of the present invention in communication.

As illustrated in FIGS. 5A and 5B, the combination the sleeve 20 and the collar 22 comprises a sleeve/collar combination 54. As previously noted the collar support post 60 of the first collar half 60*a* and the collar support 80 of the second collar half 60*b* are in removable communication to comprise a collar support post 87. A top portion extension 88 of the top portion 44 is in extendable communication from the top collar marginal edge portion 68. The top portion extension 88 comprises the top marginal edge portion 52 and at least a portion of the two opposed side marginal edge portions 48 of the top portion 44. The top portion extension 88 further comprises at least one of the cut out edge portion 54, the tabs 56 and the top marginal edge ridge 82.

Figure 6:
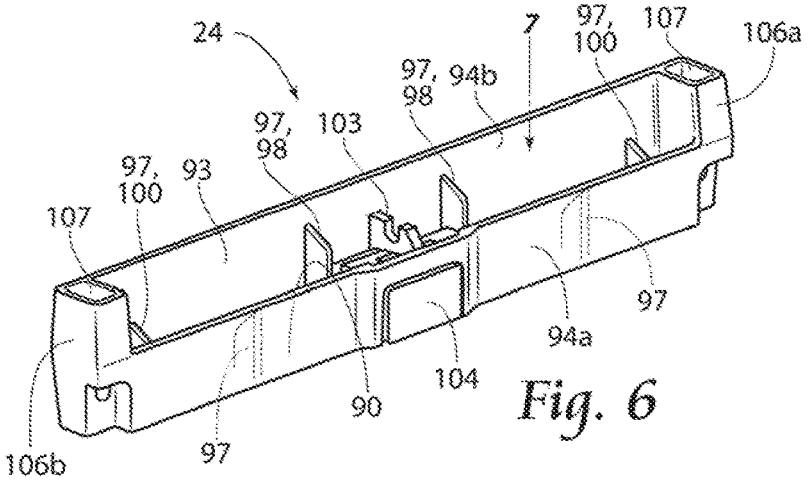
FIG. 6 is a bottom perspective view of a first embodiment of a holder of the present invention.
Figure 7:
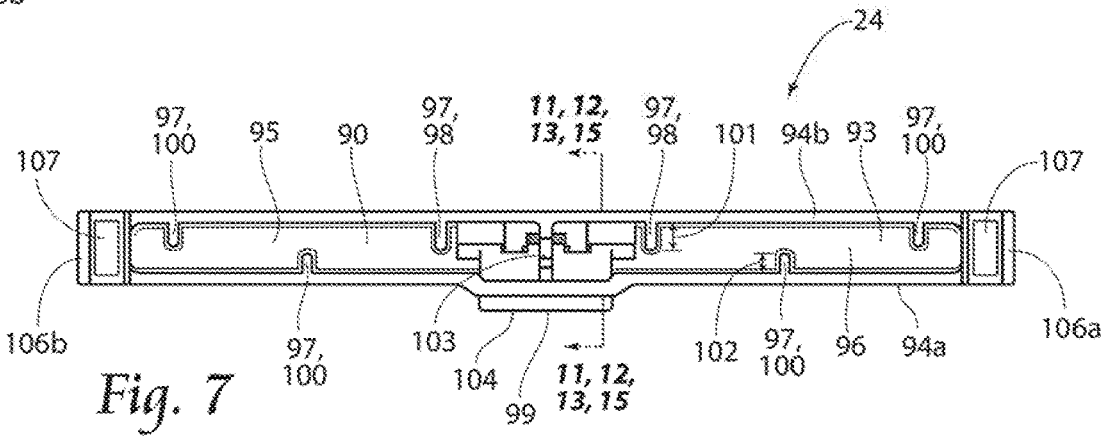
FIG. 7 is a bottom view of a first embodiment of the holder of the present invention.
Figure 8:
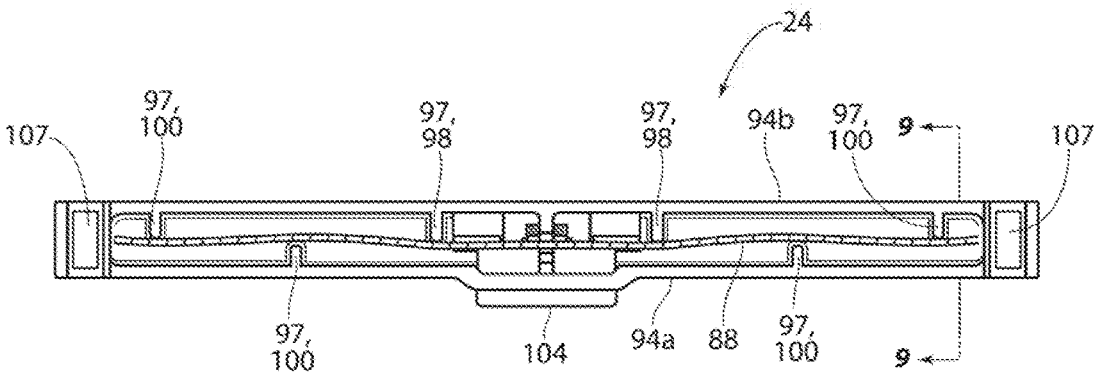
FIG. 8 is a bottom view of a first embodiment of the holder of the present invention in communication with a cross-section of the first embodiment of the card retaining sleeve of the present invention.

As illustrated in FIGS. 6 and 7, the holder 24 for use with the first embodiment of the card holding assembly 18 may be seen. The holder 24 preferably includes a holder top 92, a holder bottom 93, and two side walls 94*a*, 94*b* forming a holder cavity 95 there between. The cavity 95 includes an entrance slot 96 for receiving a retaining sleeve 12 into the holder 24. The entrance slot 96 is adapted to receive the top portion 44 of the card retaining sleeve 20, specifically the top portion extension 88 of the card retaining sleeve 20. As illustrated particularly in the view of FIG. 7, the cavity 95 includes side walls 94*a*, 94*b* having retention ridges 97. The retention ridges 97 extend laterally inwardly from the side walls 94*a*, 94*b* and into the cavity 95. With a view to FIG. 7, it may be seen that the ridges 97 on sidewall 94*a* and the ridges 97 on sidewall 94*b* do not line up with one another, but rather, are preferably staggered or off set from one another to produce the desired effect as illustrated in FIG. 8. It is observed the ridges 97 are of at least two different sizes wherein the central ridges 98 in close proximity to holder center axis 99 and the remaining ridges 100 are of a second size. Wherein the central ridges 98 are preferably extending a central ridge distance 101 into the cavity and the remaining ridges 100 extend a remaining ridge distance 102 into the cavity. The central ridge distance 101 is preferably greater than the remaining ridge distance 102. Alternatively, the central ridge distance 101 may be substantially equal to the remaining ridge distance 102. As seen in FIGS. 6 and 7, the holder 24 may be further provided with a rigid sleeve receiver 103 located at least in close proximity to the holder central axis 99. The receiver 103 providing for receiving the top portion extension 88, and adding additional stability to the first embodiment of the card holding assembly 18. The holder further comprising mechanical sleeve retention, such as the spring biased button mechanism 104.

The holder is further defined by oppositely holder ends (106*a*, 106*b*), separated by the cavity 95. Each holder end (106*a*, 106*b*) provides for a post cavity 107, wherein the post cavity 107 receives a collar support post 87 when the sleeve/collar combination 84 and the holder 24 are in removable communication.

Figure 9:
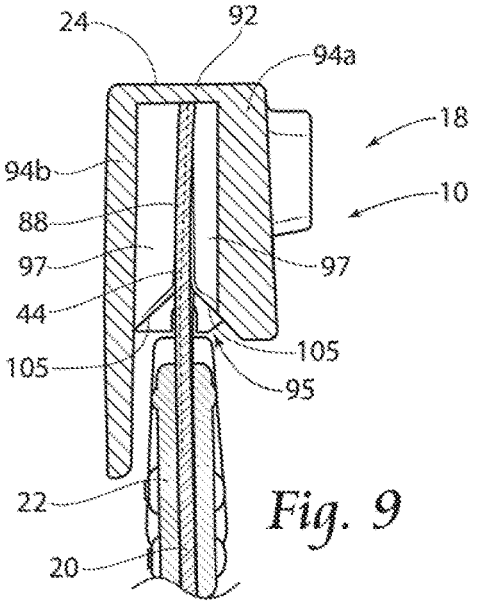
FIG. 9 is a cross-sectional view of the first embodiment of the card holding assembly of the present invention.

The views of FIGS. 8 and 9 illustrate the holder 24 with the sleeve 20 in use position. As shown, the retention ridges (97, 98, 100) contact the top portion extension 88 of sleeve 20 to thereby deform the top portion 88. Deformation of the top portion 88 at each retention ridge (97, 98, 100) reduces sleeve 20 rattle and vibration within the sleeve holder 24 when the card holding assembly 18 is affixed to a moving object, such as a golf cart 11 (see FIG. 1). The view of FIG. 9 specifically illustrates this deformation. The deformation of the top portion 88 creates force between the top portion 88 and the holder 24 at each retention ridge (97, 98, 100). The deformation also creates a friction force to aid in retaining the sleeve 20 in the holder 24. As seen in FIGS. 6, 7, and 8, the sleeve holder 24 may further include other mechanical mechanisms to retain the sleeve 20 in the holder 24. For example, the spring biased button mechanism 104 seen in FIGS. 6, 7, 8 and 10 provides retaining force on the sleeve member 20 that is user friendly, as will be discussed. As further illustrated in FIG. 9, the ridges 97 comprising ramped leading edge 105. The ramped leading edges 105 of the ridges encourage facile insertion of the sleeve 20 during use.

Figure 10:
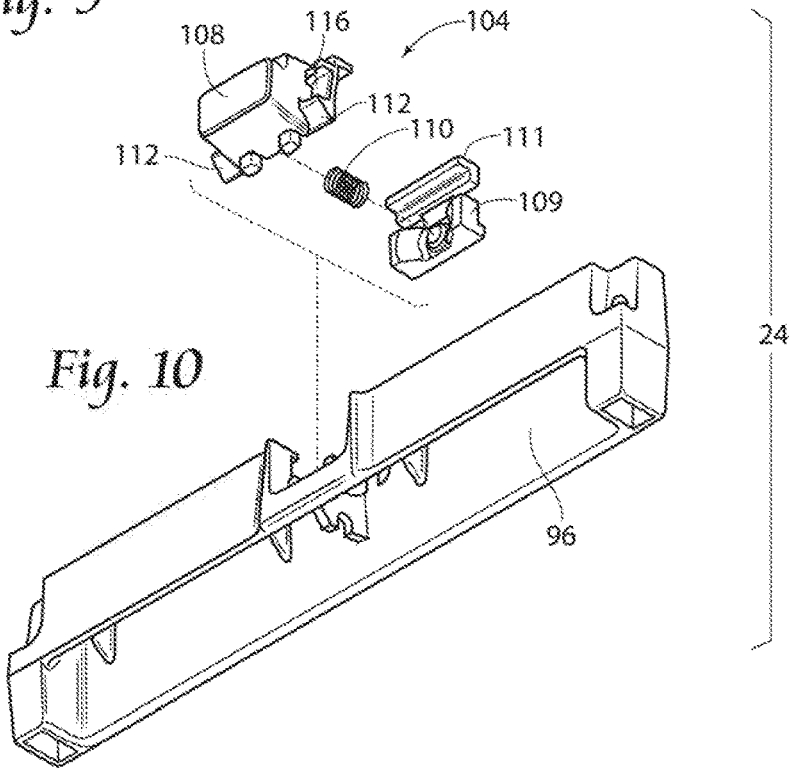
FIG. 10 is an exploded view of the first embodiment of the holder of the present invention.
Figure 11:
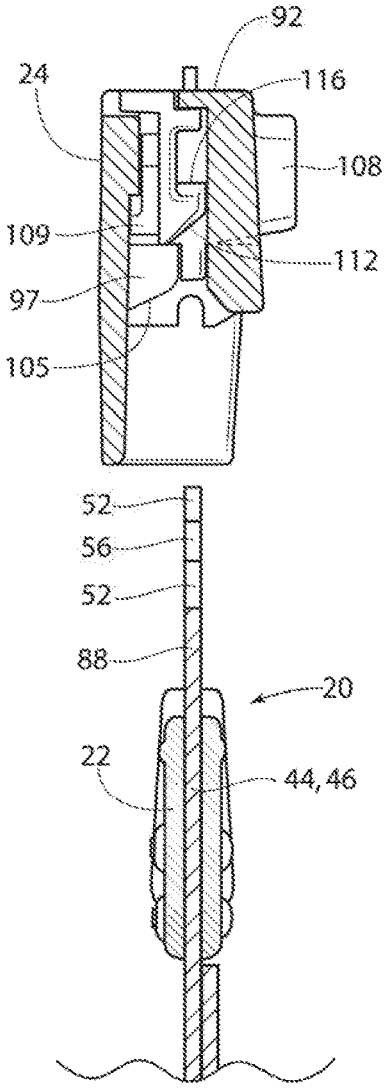
FIG. 11 is a method of operating the first embodiment of the card holding assembly of the present invention.
Figure 12:
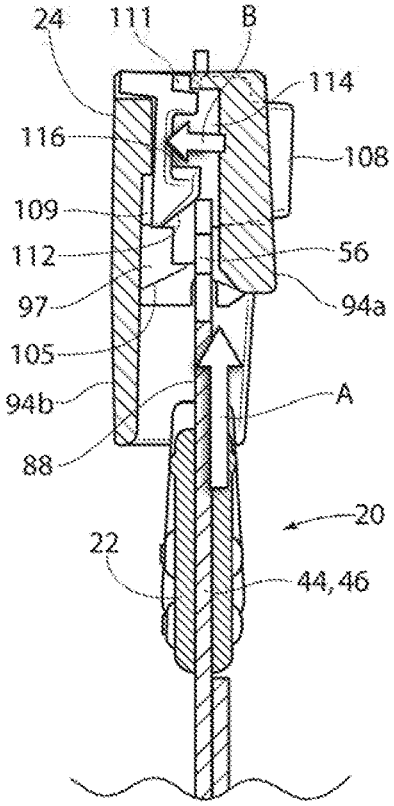
FIG. 12 is the method of operating the first embodiment of the card holding assembly of the present invention, illustrating insertion of the first embodiment of the card retaining sleeve and the first embodiment of the collar into the first embodiment of the holder of the present invention.

As illustrated in FIG. 10, it may be seen that the button mechanism 104 includes a button member 108, a stroke limiter 109, and a compression spring 110. The stroke limiter 109 includes a flange 111 to limit the travel or stroke of the button member 108. Limiting the stroke of the button member 108 is desired since unlimited stroke would allow the button member 108 to move to a fully depressed condition at which point the button mechanism 104 may become disassembled. The button member 108 further includes a ramp portion 112, and an opposite back surface 116.

The holder 24 is preferably fixed to a vehicle 11 in a following manner. The side wall 94*b* is in removable communication with vehicle surface 125, reference FIG. 26. The side wall 94*b* may be mounted to a block extension 171 of the vehicle surface 125. The mounting is provided for by at least one side wall thru hole 172 in at least substantial alignment with a block thru bore 173, such that at least one of a screw, rivet and pin 86' are inserted to provide a rigid connection between the card retaining assembly 18" and the vehicle 11, reference FIG. 26.

Action of the button mechanism 54 in retention of the sleeve member 12 is best seen in the views of FIGS. 11 to 15. The user may easily and quickly install the sleeve 20 in the sleeve holder 24. To engage the sleeve 20 in the sleeve holder 24, the sleeve 20 is first inserted into the slot 96 of sleeve holder 24. As the sleeve is moved in the direction of arrow A, the top profile extension 88 is directed by the ramped leading edge 51 into the slot 96, reference FIG. 12. The tabs 56 of the top profile 46, top profile extension 88, then come in contact with the ramp portion 112 of button member 108. Continued movement of the sleeve member 12 in the direction of arrow A increases pressure on the ramp portion 112 by the tabs 56 and creates a downward force on the ramp portion 112 in the direction of arrow B, reference FIG. 12. Further movement of the button member 108 and ramp 112 in the direction of arrow B creates a gap 114 between the ramp 112 and the sidewall 94*a*. The gap 114 permits the top edge 52 and tabs 56 to advance further into the cavity 95 and toward the holder top 92 of the holder 24. The tabs 56 move over and beyond the ramp portion 112 where the tabs 56 finally seat against the back surface 116 of a respective ramp portion 112 while the button 108 moves in the direction of arrow C to secure the sleeve member 20 in the holder 24, reference FIG. 13.

Figure 13:
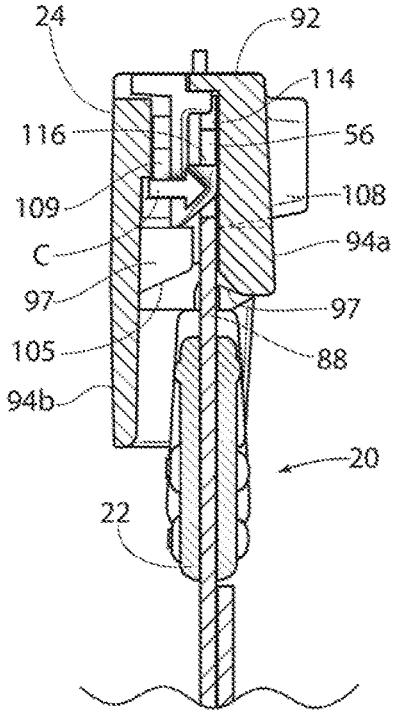
FIG. 13 is the method of operating the first embodiment of the card holding assembly of the present invention, illustrating locking of the first embodiment of the card holding assembly of the present invention.
Figure 14:
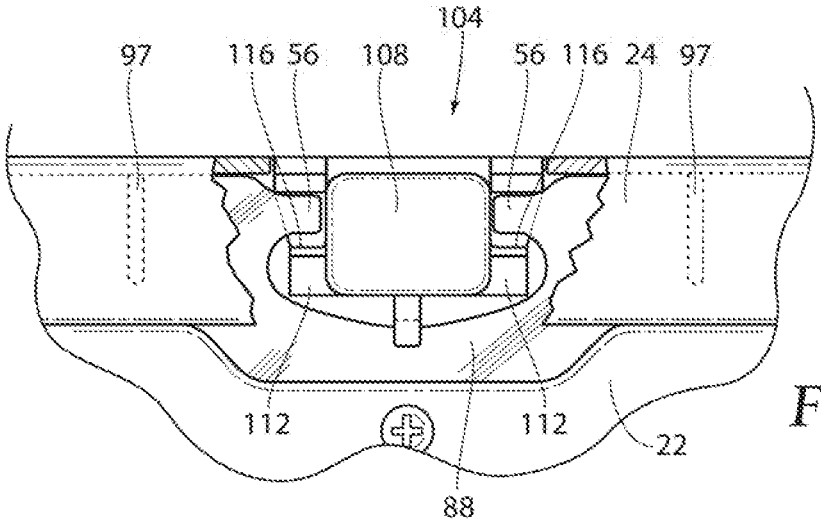
FIG. 14 is a the method of operating the first embodiment of the card holding assembly of the present invention, illustrating arrangement of various components when the first embodiment of the card retaining sleeve and the first embodiment of the collar are seated into the first embodiment of the holder of the present invention.
Figure 15:
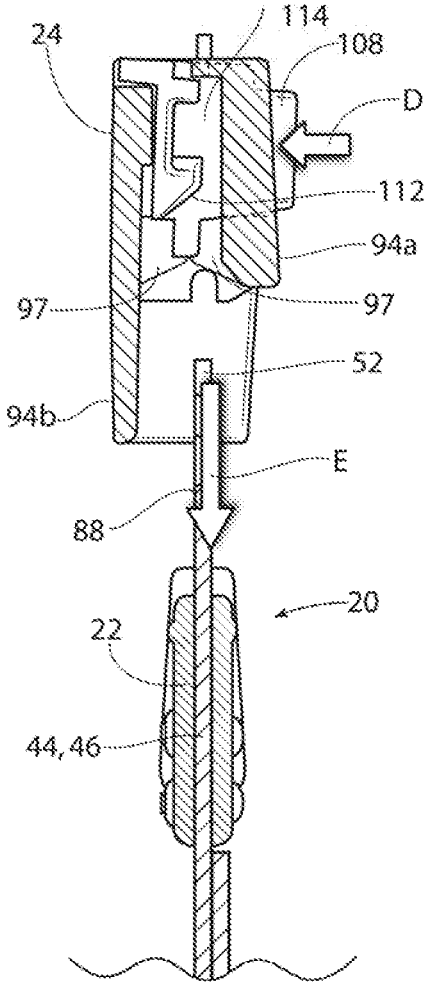
FIG. 15 is the method of operating the first embodiment of the card holding assembly of the present invention, illustrating release of the first embodiment of the card retaining sleeve and the first embodiment of the collar from the first embodiment of the holder of the present invention.

The position of the sleeve 20 and holder 24 illustrated in FIGS. 13 and 14 depicts the sleeve 20 securely positioned in the sleeve holder 24, with the button mechanism 104 locking the sleeve 20 in place, and the tabs 56 resisting pullout in the direction of arrow E, reference FIG. 15, due to their engagement against back surface 116. With specific attention to FIG. 14, the tabs 56 may be viewed positioned against the back surface 116 of the ramps 132.

Release of the sleeve 12 may be seen in the view of FIG. 15. As shown, the button member 108 is depressed and biased against the action of the compression spring 110 in the direction of arrow D. The ramps 112 are thereby moved downward while also moving the back surface 116 to permit the release of the tabs 56. The action also creates the gap 114 to permit removal of the sleeve 20 from the holder 24 in the direction of arrow E.

Figure 16:
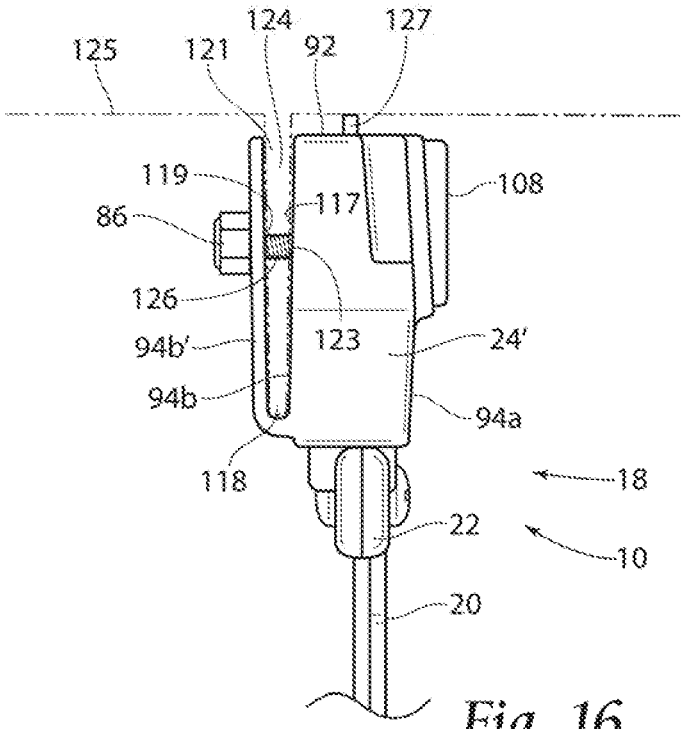
FIG. 16 is a side view of the first embodiment of the card holding assembly of the present invention to the vehicle, illustrating a second embodiment of the holder of the present invention.

With attention to FIG. 16, a second embodiment of the holder 24' is illustrated. It is observed at least one element of the first embodiment of the holder 24 may be employed with at least one element of the second embodiment of the holder 24'. The second embodiment of the holder 24' comprising a second embodiment of the second side wall **94*b*'. Wherein the second embodiment of the side wall 94*b*' comprises a groove 118 extending from at least substantially close to the first holder end 106A along the holder length 30, reference FIG. 2, to at lease substantially close to the second holder end 106B. The groove 118 defined by a first groove wall 117, which is the second side wall 94*b*, and a groove wall extension 122. The groove wall extension in fixed communication with the first groove wall 117 and extending opposite the button member 108. The groove 118 having a groove opening 121 at least in close proximity to the holder top 92. The groove extension wall 122 having at least one groove wall thru hole 119 in alignment with an at least one first groove wall receiving bore 123. Wherein at least one of a screw, rivet, and pin 86 may be in removable communication with the at least one groove wall thru hole 119 and the at least one first groove wall receiving bore 123. The groove opening 121 designed to receive a flange 124 extending from a vehicle surface 125 of the vehicle 11. Wherein the flange 124 having at least one flange thru hole 126 in at least substantial alignment with the at least one groove wall thru hole 119 and the at least one first groove wall receiving bore 123 such that the removable communication of the at least one of a screw, rivet, and pin 86 will provide for fixed communication of the card holding assembly 10, 18 to the vehicle 11. The second embodiment of the holder 24' provides for reduced vibration of the card holding assembly 10, 18 when the card holding assembly 10, 18 is in operation on the vehicle 11**.

With attention to FIGS. 2, 3, 4, and 16, at least one node 127 extends from the holder top 92. As illustrated in FIG. 16, the node contacts the vehicle surface 125 to provide for reduced vibration of the card holding assembly 10, 18 when the card holding assembly 10, 18 is in operation on the vehicle 11.

Figure 17:
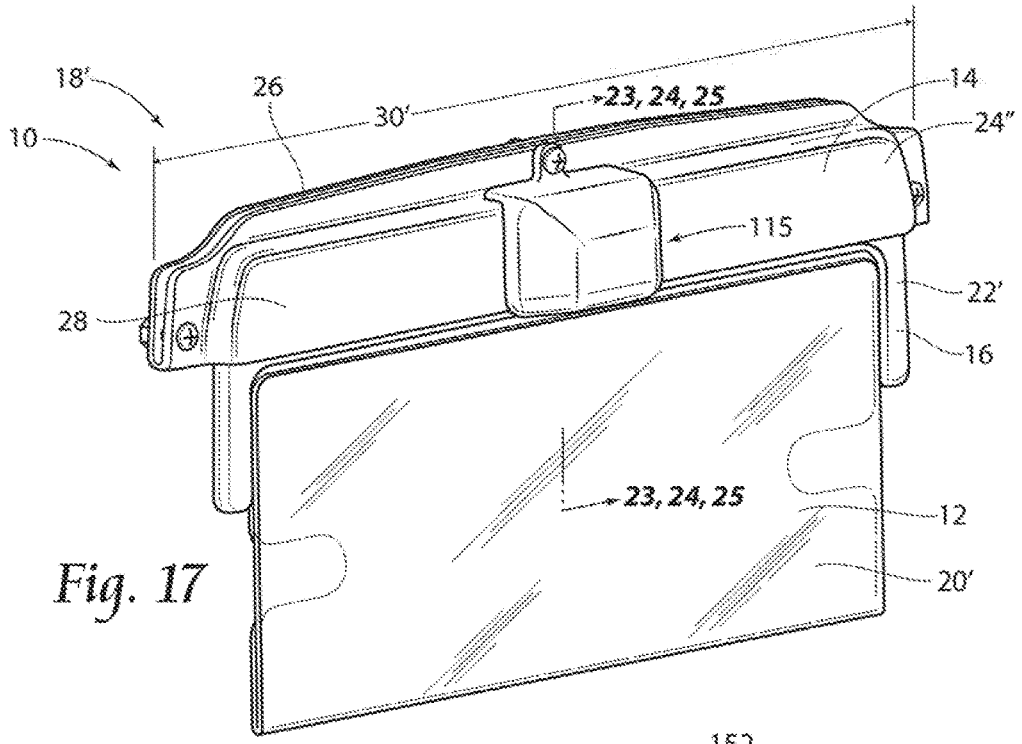
FIG. 17 is a perspective view of a second embodiment of the card holding assembly of the present invention.

With attention to FIGS. 17 to 22, a second embodiment of the card holding assembly 18' is illustrated. As illustrated in FIG. 17, the second embodiment of the card holding assembly 18' comprises a second embodiment of the card retaining sleeve 20', a second embodiment of the collar 22', and a third embodiment of the holder 24". Wherein the card retaining sleeve 20', the collar 22' and the holder 24" are in fixed and removable communication. The fixed communication provides for reduced vibration of the card holding assembly 18 while the vehicle 11, reference FIG. 1, on which the card holding assembly 18' is attached is in operation. The holder 24' comprises a holder mounting side 26 and an opposite holder operational side 28, extending a holder length 30'.

Figure 18:
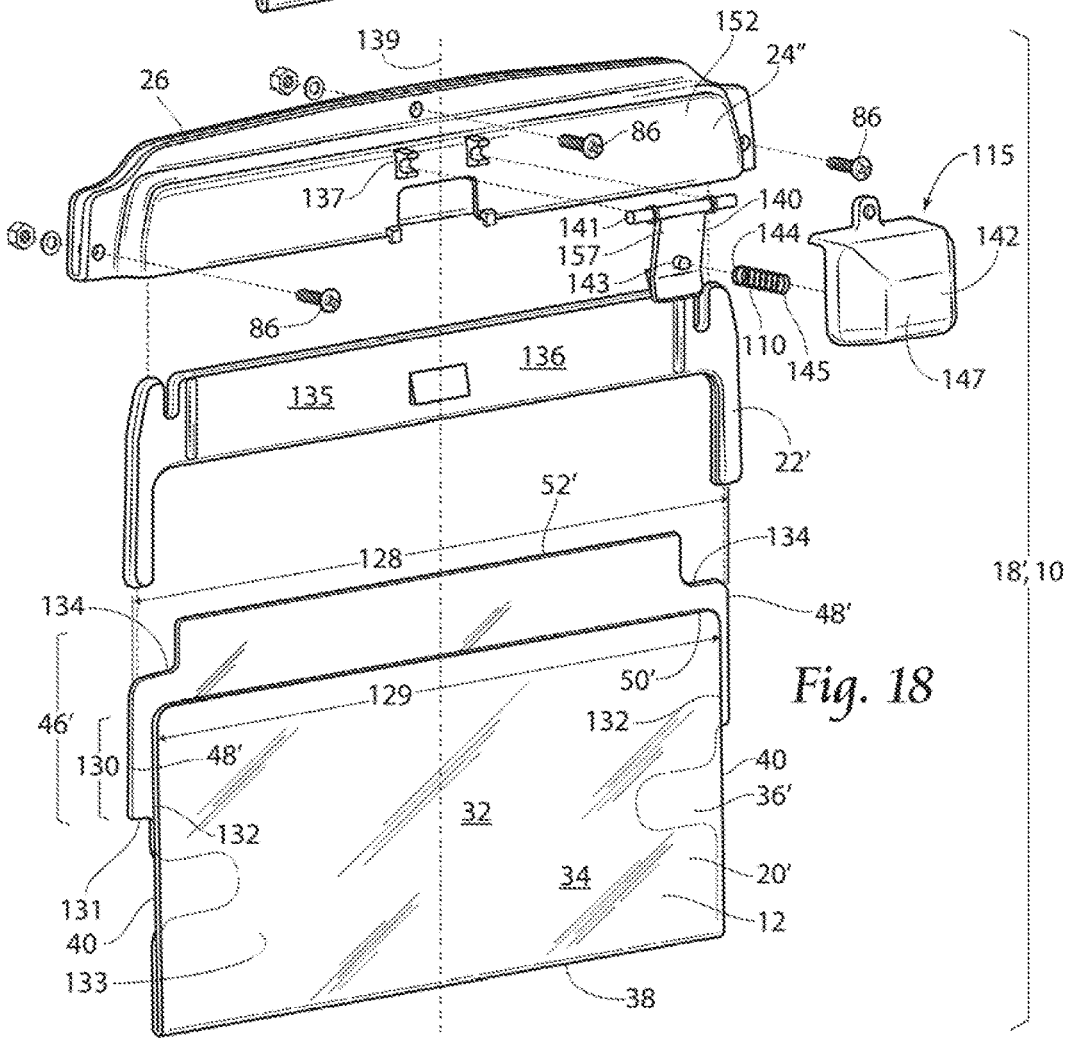
FIG. 18 is an exploded view of the second embodiment of the card holding assembly of the present invention.

As illustrated in FIG. 18, the card retaining sleeve 20' preferably includes a sleeve body 32 having a front panel 34, a second embodiment of the back panel 36', and at least one closed edge 38. Wherein the front panel 34 and the back panel 36' define the sleeve body 32. The retaining sleeve 20 further includes two opposed side edges 40, at least one side edge 40 being open to permit a card member 42, as illustrated in FIG. 4, passage into the sleeve body 32. The card retaining sleeve 20 further includes a top portion second embodiment 44', oppositely disposed from the closed edge 30. As shown, the top portion 44' extends laterally from the sleeve body 32 to form a preferred top marginal edge profile second embodiment 46'. The top marginal edge profile 46' further extending towards the closed edge 36 for a predetermined top marginal edge distance 130 to a marginal edge terminus 131 and providing for the back panel 36' having a back panel width 128 greater than a front panel width 129 along the predetermined distance 130.

The preferred top marginal edge profile 46' Includes two opposed side marginal edge portions second embodiment 48' extending laterally from the sleeve body 32 two oppositely opposed side edge portions 132, defined by at the marginal edge terminus 131, and a bottom edge portion second embodiment 50' attached to the sleeve body 32. Wherein the two oppositely opposed side edge portions 132 intersect the bottom edge portion 50' to define a border between the top portion 44' and the back panel body 133 of the back panel 36'. Wherein the bottom edge portion 50' is opposite the closed edge 38. The top portion 44' further extending laterally from the bottom edge portion 50' and defined by the two opposed side marginal edges 48', wherein the two side marginal edges 48' extend inwardly substantially parallel to the bottom edge portion 50' for a predetermined distance to a first position 134. From the first position 134, the oppositely opposed two side marginal edges 48' extend substantially parallel to one another and opposite the closed edge 38. A top marginal edge portion second embodiment 52' intersects with the opposed side marginal edges 48'.

Figure 19A:
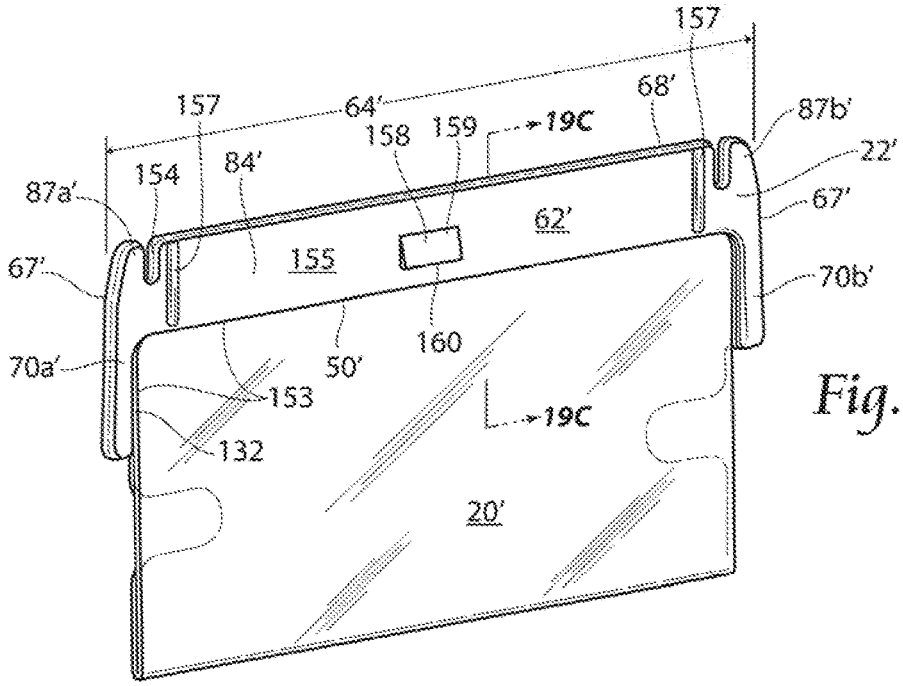
FIG. 19A is a front perspective view of a second embodiment the card retaining sleeve of the present invention and a second embodiment of the collar of the present invention in communication.
Figure 19B:
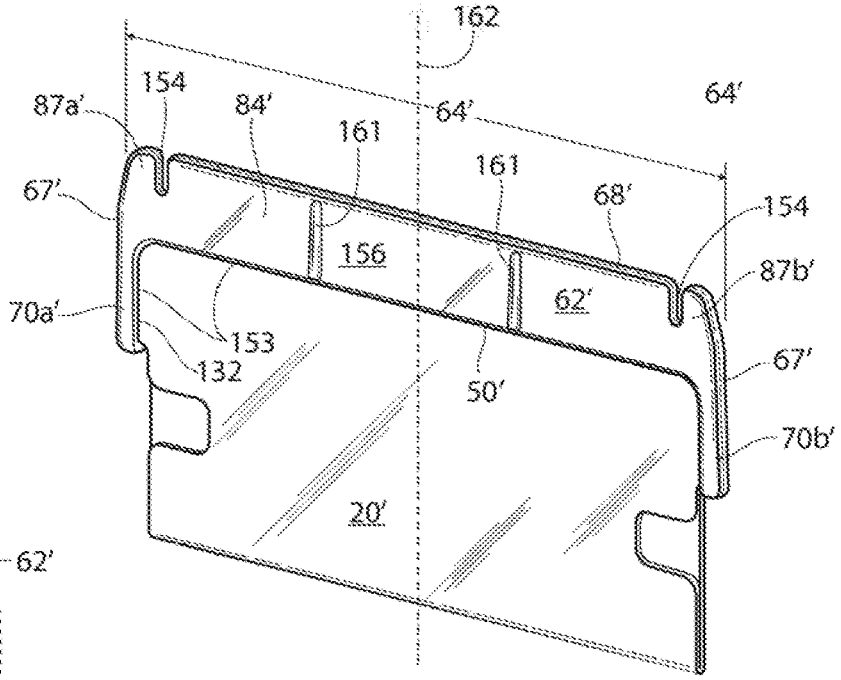
FIG. 19B is a rear perspective view of the second embodiment the card retaining sleeve of the present invention and the second embodiment of the collar of the present invention in communication.

The profile 46' is adapted for engagement with the collar 22'. Specifically, the collar 22' comprising a single piece unit 135 adapted to fit about the profile 46'. Preferably, the collar 22' is a single piece over-mold unit 136, wherein the collar 22' is in molded communication with the profile 46'. As illustrated in FIGS. 19A and 19B, the combination the sleeve 20' and the collar 22' comprises a second embodiment of the sleeve/collar combination 84'.

Figure 23:
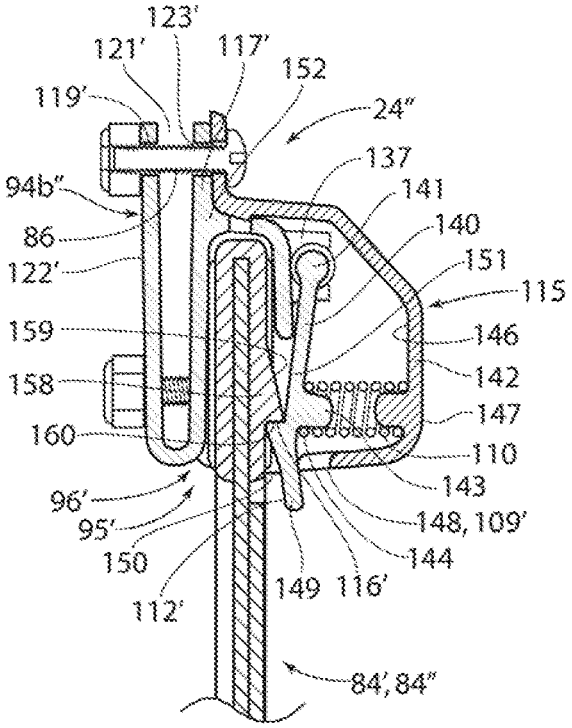
FIG. 23 is a cross-sectional view of the second embodiment of the card holding assembly of the present invention in a locked position.

As further illustrated in FIGS. 18 and 23, the holder 24" comprising a lever mechanism 115. The lever mechanism 115 is preferably positioned on the holder operational side 28. The lever mechanism 115 is further preferably positioned in at least in close proximity to a card holding assembly central axis 139. It may be seen that the lever mechanism 115 includes at least two lever mounts 137 oppositely opposed on the operational side 28 and extending opposite the mounting side 26. The lever mechanism 115 further includes a lever 140, a compression spring 110 and a stroke limiting cap 142. The lever 140 is in rotational communication with the lever mounts 137 about a lever axle 141 of the lever 140. A lever arm 151 extending from the lever axle in the direction of the entrance slot 96. The lever arm 151 having a lever node 143 about which a spring first end 144 communicates. A spring second end 145 communicates with a cap node 142. The cap 142 comprising a shell with a cap inner surface 146 positioned in the direction of the operational surface 29 and a cap outer surface 147. Communication of the spring 110 to the lever arm 151 and cap 142 provides for a return motion of the lever arm 151 to a locked position. A stroke limiter second embodiment 109' includes a cap edge 148 to limit the travel or stroke of the lever 140. Limiting the stroke of the lever 140 is desired since unlimited stroke would allow the lever 140 to move to a fully extended condition at which point the lever mechanism 115 may become disassembled after repeated movement. The cap edge 148 provides for a cap gap 150 thru which a lever end 149, opposite the lever arm 141 extends in the direction of the entrance slot 96. The lever arm 151 further includes a ramp portion second embodiment 112', and an opposite surface lever back portion 116'. It is observed the cap is removable fixed to the holder body 152 of the holder 24' thru at least one of a screw, rivet and pin 86.

Figure 19C:
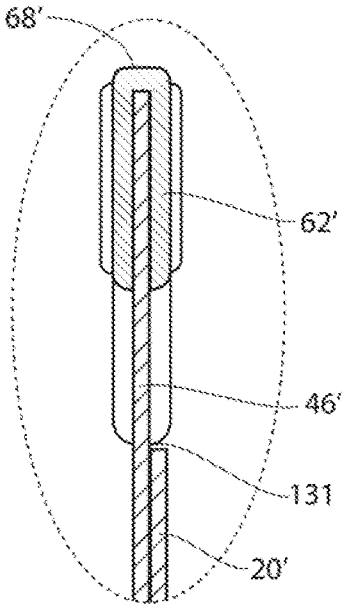
FIG. 19C is a cross-sectional view of the second embodiment the card retaining sleeve of the present invention and the second embodiment of the collar of the present invention in communication.

As illustrated in FIGS. 19A to 19C, the combination the sleeve 20' and the collar 22' comprises a sleeve/collar combination second embodiment 84'. The collar 22' comprising a collar body second embodiment 62' and collar arms second embodiment (70*a*', 70*b*'). The collar 22' having a collar body length second embodiment 64' and defined by oppositely opposed collar side edges second embodiment 67'. A cop collar marginal edge portion second embodiment 68' intersects with the opposed collar side edges 67'. The collar arm (70*a*', 70*b*') extends laterally defined by each side marginal edge 67' along the predetermined top marginal edge distance 130 towards and beyond the marginal edge terminus 131. The collar body 22' is defined by the top collar marginal edge portion 68' intersection with the opposed collar side edges 67'. Wherein the collar arm (70*a*', 70*b*') is in extendable communication laterally from a collar base edge second embodiment 76' The collar base edge 76' and the collar arm (70*a*', 70*b*') complement the bottom edge portion 50' and side edge portions 132 to form, a collar base 153.

A collar support post second embodiment. (87*a*', 87*b*') extends laterally with respect to the collar body 22' in close proximity to each of the opposed collar side edges 67'. Wherein the collar support post (87*a*', 87*b*') is defined by one of the opposed collar side edges 67', the top collar marginal edge portion second embodiment 68', and an at least one collar groove 154. Wherein the collar groove 154 extends from a collar first side 155 to a collar second side 156. Wherein the collar groove 154 extends from the top collar marginal edge portion second embodiment 68' and towards the collar base 153.

Along the collar first side 155, at least one collar first rib 157 is in communication with the collar first side 155 in close proximity to the at least one collar groove 154. The collar first rib 157 extending from at least in substantial close proximity to the top collar marginal edge portion second embodiment 68' to at least in substantial close proximity to the collar base 153. A collar ledge 153 extending from the collar first side 155. Wherein the collar ledge 158 having a ramped ledge surface 159 and an opposite base surface 160. The base surface 160 positioned towards the collar base 153. The collar second side 156 providing for at least one collar second rib 161. The collar second rib 161 is in communication with the collar second side 156 in close proximity to a collar center axis 162. The collar second rib 157 extending from at least in substantial close proximity to the top collar marginal edge portion second embodiment 68' to at least in substantial close proximity to the collar base 153.

Figure 20A:
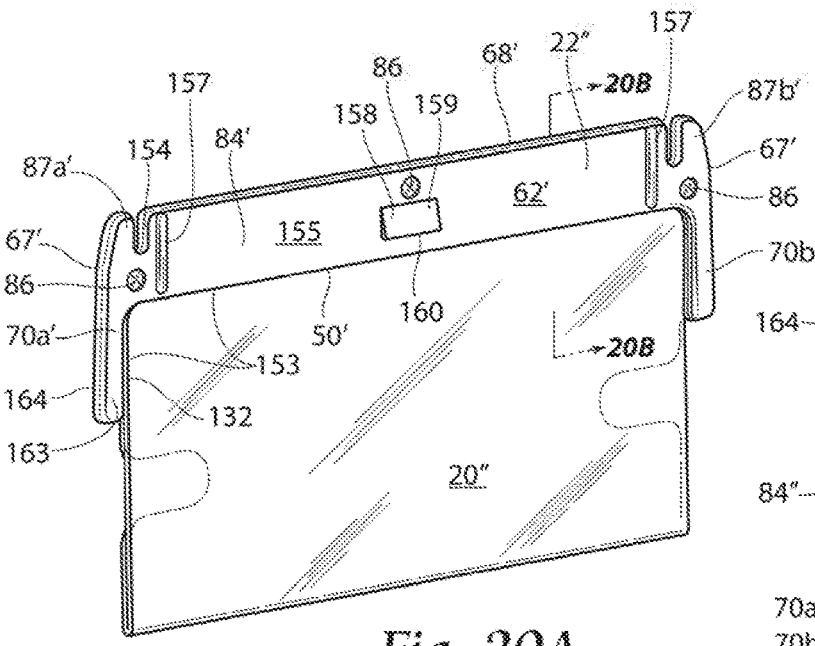
FIG. 20A is a front perspective view of the third embodiment the card retaining sleeve of the present invention and a third embodiment of the collar of the present invention in communication.
Figure 20B:
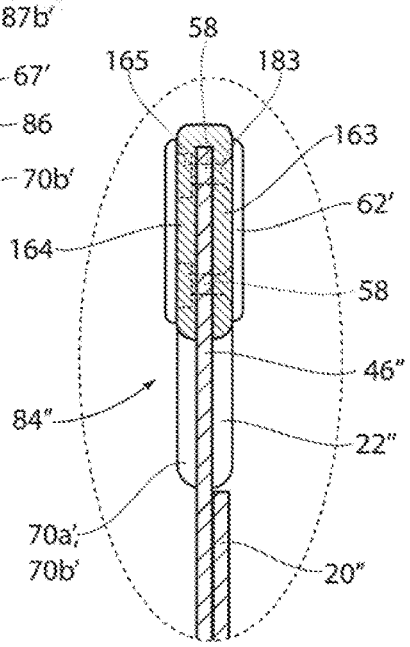
FIG. 20B is a cross-sectional view of the third embodiment the card retaining sleeve of the present invention and the third embodiment of the collar of the present invention in communication.

As illustrated in FIGS. 20A and 20B, the combination a sleeve third embodiment 20" and a collar third embodiment 22" comprises a sleeve/collar combination third embodiment 84". It is observed the sleeve third embodiment 20" incorporates the elements of the sleeve second embodiment 20' with the following elements. The sleeve 20' provides for a top marginal edge profile third embodiment 46" and a third embodiment of the collar 22". The top marginal edge profile third embodiment 46" incorporates the elements of the top marginal edge second embodiment with the following elements. The top marginal edge 46" provides for, at least one through hole 58. The third embodiment of the collar 22" incorporates the elements of the second embodiment of the collar 22' with the following elements. The third embodiment of the collar 22" comprises a first third embodiment half 163 and a second third embodiment half 164. It is observed the first third embodiment half 163 and a second, third embodiment half 164 complement one another to create the collar body 62', the collar arms (70*a*', 70*b*'), and collar support post (87*a*', 87*b*'). It is observed the third embodiment of the collar 22" functions is the same manner as the second embodiment of the collar 22' as previously described. It is observed that the first third embodiment half 163 comprises at least one first half thru hole 183 and the second third embodiment half 164 comprises at least one second half thru hole 165. Wherein the at least one first half thru hole 183 is at least substantially in alignment with the at least one second half thru hole 165. Wherein alignment of the at least one first half thru hole 164 is at least substantially in alignment with the at least one second half thru hole 165 and at least one through hole 58 of the top marginal edge 46" provides for insertion of an lease one of a screw, rivet and pin 68 to provide for securing the sleeve 20" between the first third embodiment half 163 and the second third embodiment half 164 to provide for sleeve/collar combination third embodiment 84" with minimal vibration during operation of a vehicle 11.

It is observed the collar 22' may comprise a two-piece construction as in the two piece construction (163, 164) of the collar 22". It is observed where the collar 22' is of a two piece construction as previously described, the collar may provide for thru holes (165, 183), as in the collar 22", to provide for retention of the sleeve (20, 20', 20") with a screw, rivet and pin 68. It is observed where the collar (22', 22") is of a two piece construction, the collar (22', 22") may be attached to the sleeve (20, 20', 20") thru the use of at least one of at least one snap feature and sonic welding connecting the respective halves of the collar (22', 22"). It is observed the collar 22" may be a single piece over-mold unit 136, as in the over-mold unit 136 of FIG. 18, wherein the collar 22" is in molded communication with the profile (46', 46").

Figure 21:
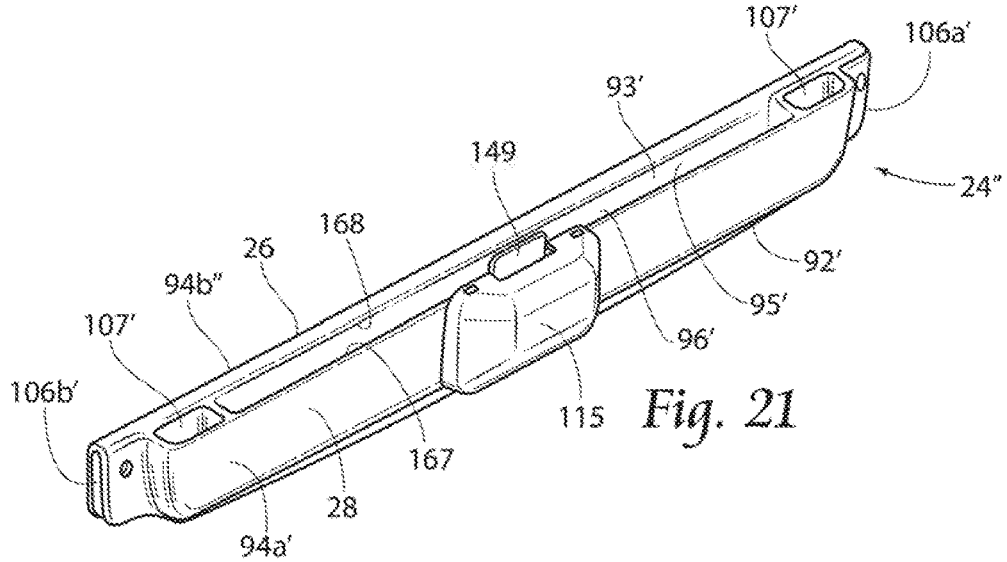
FIG. 21 is a bottom perspective view of a second embodiment of the holder of the present invention.
Figure 22:
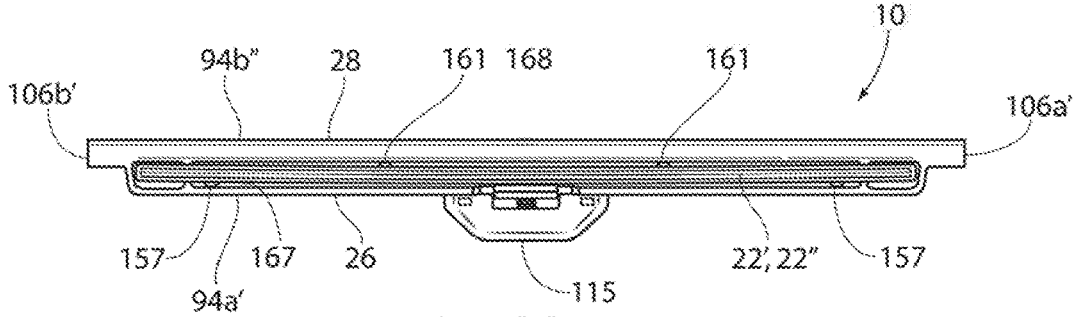
FIG. 22 is a bottom view of the third embodiment of the holder of the present invention.

With attention to FIGS. 21 to 23, the third embodiment of the holder 24" is further illustrated. It is observed at least one element of the first embodiment of the holder 24 may be compatible with at least one element of the third embodiment of the holder 24". It is observed at least one element of the second embodiment of the holder 24' may be compatible with at least, one element of the third embodiment of the holder 24". The third embodiment of the holder 24" comprising a second embodiment of the first side wall 94*a*' and a third embodiment of the second sidewall 94*b*'. The first sidewall 94*a*' providing for the holder operational side 28 and comprising the lever mechanism 113. The second side wall 94*b*" providing for a second embodiment of a groove 118' to receive a flange 124, reference FIG. 16. The holder 24" preferably includes a holder top 92', a holder bottom 93', and the two side walls 94*a*', 94*b*" forming a holder cavity 95' there between. The cavity 95' includes an entrance slot 96' for receiving a retaining sleeve (20', 20") into the holder 24". The entrance clot 96' is adapted to receive the collar (22', 22"). As illustrated particularly in the view of FIG. 22, the cavity 95' includes is defined by a front inner wall 167 and an oppositely opposed back inner wall 168. When the collar (22', 22") is inserted in the cavity 96', at least one of the collar first rib 157 of the collar (22', 22") is in contact with the front inner wall 167. The frictional contact between the collar first rib 157 of the collar (22', 22") and the front inner wall 167 provides for a reduced vibration of the card holding assembly 10. When the collar (22', 22") is inserted in the cavity 95', at least one of the collar second rib 161 of the collar (22', 22") is in contact with the back inner wall 168. The frictional contact between the collar first rib 157 of the collar (22', 22") and the back inner wall 168 provides for a reduced vibration of the card holding assembly 10.

The holder is further defined by oppositely holder ends (106*a*', 106*b*'), separated by the cavity 95. Each holder end (106*a*', 106*b*') provides for a post cavity 107', wherein the post, cavity 107 receives a collar support post (87*a*, 87*b*') when the sleeve/collar combination (84', 84") and the holder 24" are in removable communication.

As illustrated in FIGS. 21 and 23, the second side wall 94*b*" comprises a groove 118' extending from at least substantially close to the first holder end 106A' to at least substantially close to the second holder end 106B'. The groove 118' defined by a first groove wall 117' and a groove wall extension 122'. The groove wall extension 122' in fixed communication with the first groove wall 117' and extending opposite the lever mechanism 115. The groove 118' having a groove opening 121' at least in close proximity to the holder top 92'. The groove extension wall 122' having at least one groove wall thru hole 119' in alignment with an at least one first groove wall receiving bore 123'. Wherein at least one of a screw, rivet, and pin 86 may be in removable communication with the at least one groove wall thru hole 119' and the at least one first groove wall receiving bore 123'. The groove opening 121' designed to receive a flange 124 extending from a vehicle surface 125 of the vehicle 11, reference FIG. 16. Wherein the flange 124 having at least, one flange thru hole 126 in at least substantial alignment with the at least one groove wall thru hole 119' and the at least one first groove wall receiving bore 123' such that the removable communication of the at least one of a screw, rivet, and pin 86 will provide for fixed communication of the card holding assembly 10, 18' to the vehicle 11. The third embodiment of the holder 24" provides for reduced vibration of the card holding assembly 10, 18' when the card holding assembly 10, 18' is in operation on the vehicle 11.

Figure 24:
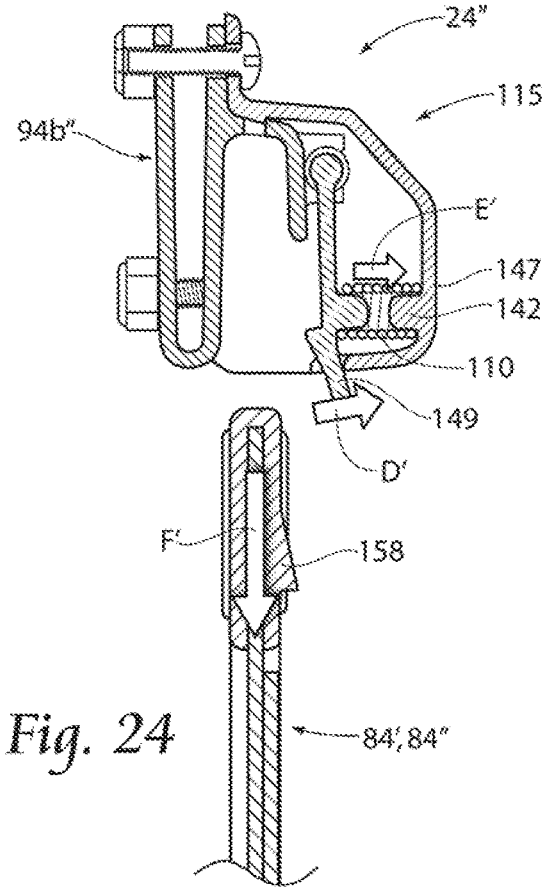
FIG. 24 is the method of operating the second embodiment of the card holding assembly of the present invention, illustrating removal of the second embodiment of the card retaining sleeve and the collar from the third embodiment of the mounting holder of the present invention.
Figure 25:
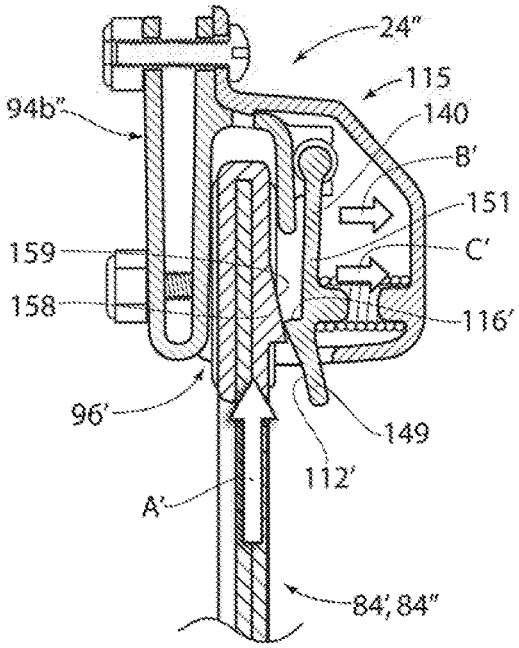
FIG. 25 is the method of operating the second embodiment of the card holding assembly of the present invention, illustrating insertion of the second embodiment of the card retaining sleeve and the collar into the third embodiment of the mounting holder of the present invention.

Action of the lever mechanism 115. In retention of the sleeve/collar combination (84', 84") is best seen in the views of FIGS. 23 to 25. As illustrated in FIG. 25, the user may easily and quickly install the sleeve/collar combination (84', 84") in the sleeve holder 24". As illustrated in FIG. 25, to engage the sleeve/collar combination (84', 84") in the sleeve holder 24", the sleeve/collar combination (84', 84") is first inserted into the slot 96' of sleeve holder 24". As the sleeve/collar combination (84', 84") is moved in the direction of arrow A', the ramped ledge surface 159 imparts pressure on the ramp portion 112' by the lever arm 151 and creates a upward force on the ramp portico 112' in the direction of arrow B'. The upward force compresses the spring 110 in the direction of the cap inner surface 146, referenced by the arrow C'. Continual motion of the sleeve/collar combination (84', 84") in the direction of the arrow A' causes continued compression of the spring 110 and movement of the lever arm 151 in the direction of arrow C'. The ramped ledge surface 159 moves ever and beyond the carp portion 112' where the collar ledge 158 finally seats against the ramped surface lever back portion 116' to secure the sleeve/collar combination (84', 84") in the holder 24", reference FIG. 23.

The position of the sleeve/collar combination (84', 84") and holder 24" illustrated in FIG. 23 depicts the sleeve/collar combination (84', 84") securely positioned in the sleeve holder 24", with the lever mechanism 115 locking the sleeve/collar combination (84', 84") in place, and the lever arm 151 resisting pullout in the direction of arrow F', reference FIG. 24, due to the lever back portion 116' of the lever arm 151 engagement against opposite base surface 160 of the collar ledge 158.

Release of the sleeve/collar combination (84', 84") may be soon in the view of FIG. 24. As shown, the lever end 149 is advanced towards the cap node 142 in the direction of arrow D'. The spring 110 is compressed in the direction E' due to the motion of the lever end 149 in the direction of arrow D'. The ramp 112' is thereby moved downward while also moving the lever back portion 116' to permit the release of the collar ledge 158. The action also permits removal of the sleeve/collar combination (84', 84") from the holder 24" in the direction of arrow F'.

Figure 26:
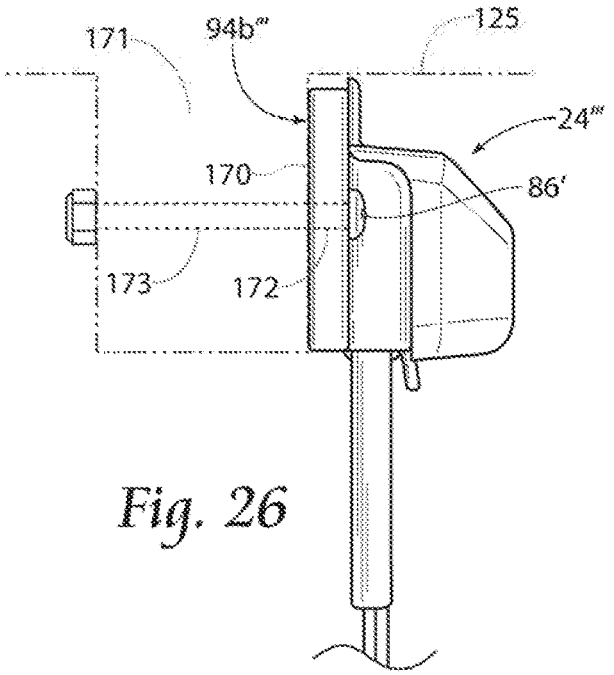
FIG. 26 is a side view of the second embodiment of the card holding assembly of the present invention to the vehicle, illustrating a fourth embodiment of the holder of the present invention.

As illustrated in FIG. 26, the second embodiment of the card retaining assembly 18" may provide for a fourth embodiment of the holder 24'". The holder 24'" comprising at least one element of at least one of the first embodiment of the holder 24, the second embodiment of the holder 24' and the third embodiment of the holder 24". The fourth embodiment; of the holder 24'" further comprising a fourth embodiment of the second side wall 94*b*'". Wherein the sidewall 94*b*'" is a solid side wall surface 170 similar to that of the sidewall 94*b*. Such that the surface 170 may be mounted to a block extension 171 of the vehicle surface 125. The mounting is provided for by at least one side wall thru hole 172 in at least substantial alignment with a block thru bore 173, such that at least one of a screw, rivet and pin 86' are inserted to provide a rigid connection between the card retaining assembly 18" and the vehicle 11.

Figure 27:
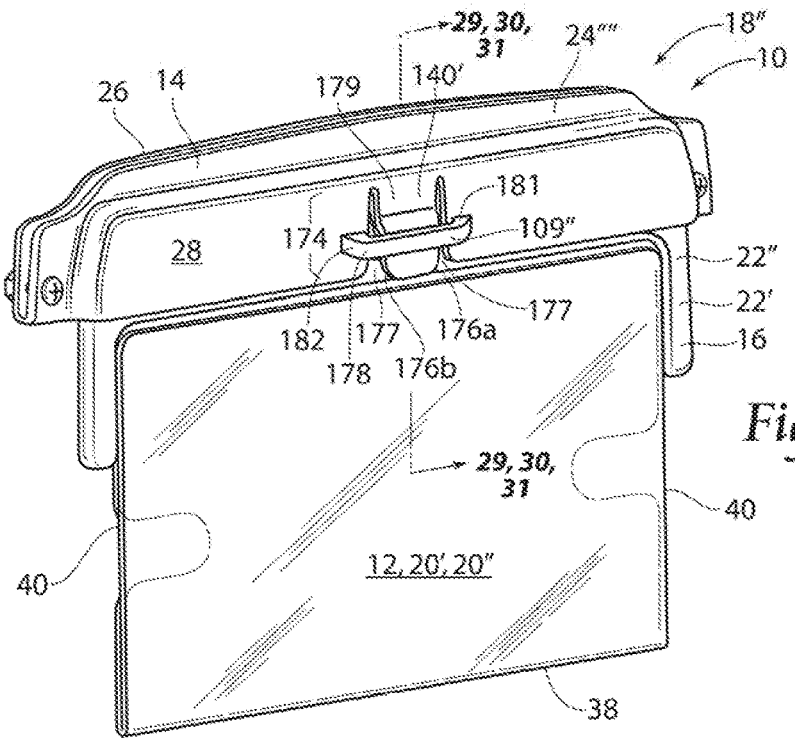
FIG. 27 is a perspective view of a third embodiment of the card holding assembly of the present invention.
Figure 28:
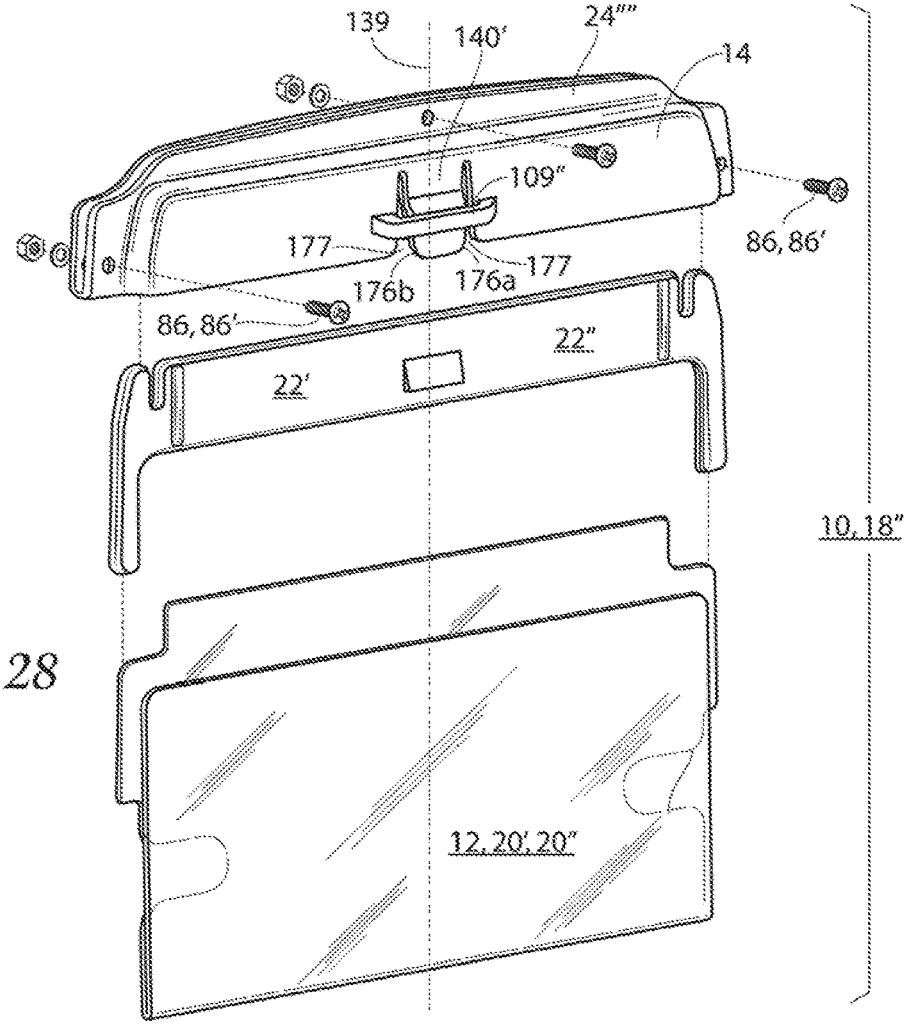
FIG. 28 is an exploded view of the third embodiment of the card holding assembly of the present invention.
Figure 29:
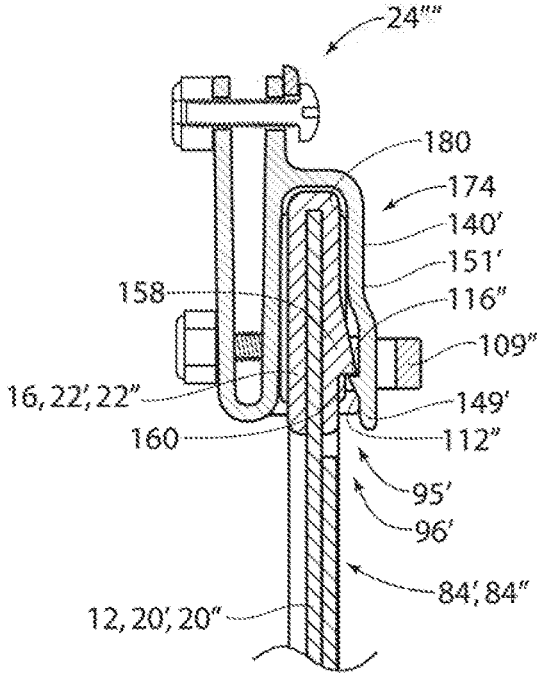
FIG. 29 is a cross-sectional view of the third embodiment of the card holding assembly of the present invention.

With attention to FIGS. 27 to 29, a third embodiment of the card holding assembly 18" is illustrated. The third embodiment of the card holding assembly 18" incorporates at least one element of the second embodiment of the card holding assembly 18', as illustrated in FIGS. 17 to 23 and FIG. 26. Specifically, the third embodiment of the card holding assembly 18" may incorporate at least one element of the second embodiment of the card retaining sleeve 20'. Specifically, the third embodiment of the card holding assembly 18" may incorporate at least one element of the third embodiment of the card retaining sleeve 20". Specifically, the third embodiment of the card holding assembly 18" may incorporate at least one element of the second embodiment of the collar 22'. Specifically, the third embodiment of the card holding assembly 18" may incorporate at least one element of the third embodiment of the collar 22". Specifically, the third embodiment of the card holding assembly 18" incorporates a fifth embodiment of the holder 24"", wherein the fifth embodiment of the holder 24"" may incorporate at least one element of the third embodiment of the holder 24". Specifically, the third embodiment of the card holding assembly 18" incorporates the fifth embodiment of the holder 24"", wherein the fifth embodiment of the holder 24"" may incorporate at least one element of the fourth embodiment of the holder 24'''.

The fifth embodiment of the holder 24"" further incorporates a hinge mechanism 174. The hinge mechanism 174 is further preferably positioned in at least in close proximity to a card holding assembly central axis 139. The hinge mechanism 174 further includes a lever second embodiment 140' and a stroke limiter third embodiment 109". A lever 140' comprising a lever arm second embodiment 151'. The lever arm 151' having a lever first end 175 and an oppositely opposed lever end second embodiment 149'. The lever end 149' further includes a ramp portion third embodiment 112", and an opposite ramped surface lever back portion 116". The ramp portion in communication with the a lever arm first surface 180, wherein the lever arm first surface 180 faces the holder cavity 95'. The lever first end 175 fixed to the operational side 28, and having opposing lateral lever edges (176*a*, 176*b*) extending from the lever end 149' to the first end 175. Wherein a lever gap 177 is provided between the operational side 28 and each lateral lever edge (176*a*, 176*b*), wherein the lever gap 177 further defines the lever 240' and lever arm 152'.

The stroke limiter third embodiment 109" comprises an arched body 178 extending about the lever arm 151'. Specifically, the stroke limiter 109" extends about a lever arm second surface 179 wherein the lever arm second surface 175 is opposite the lever arm first surface 180. A stroke limiter first end 182 is fixed to the operational side 28 in close proximity to the first lateral edge 176*a*. The stroke limiter 109" is in extended communication about the lever arm second surface 179. A stroke limiter second end 182, opposite the stroke limiter first, end 181, is in fixed communication with the operational side 28 in close proximity to the second lateral edge 176*b*. Limiting the stroke of the lever 140' is desired since unlimited stroke would allow the lever 140' to move to a fully extended condition at which point the hinge mechanism 174 may become disassembled after repeated movement.

Figure 30:
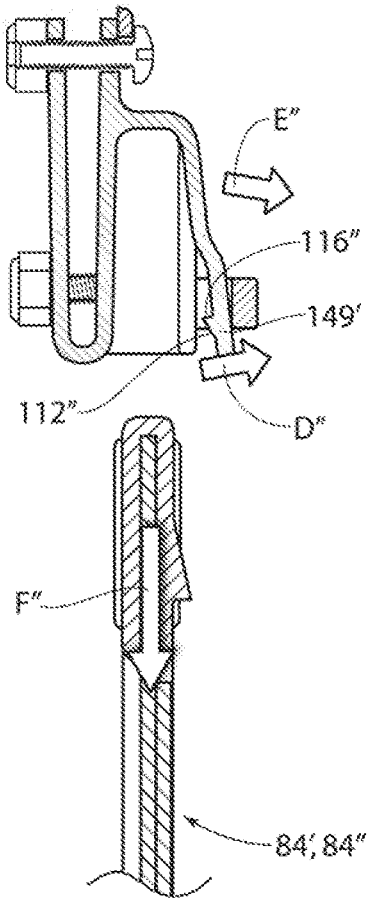
FIG. 30 is a method of operating the third embodiment of the card holding assembly of the present invention, illustrating removal of the second embodiment of the card retaining sleeve and the collar from a fifth embodiment of the mounting holder of the present invention.
Figure 31:
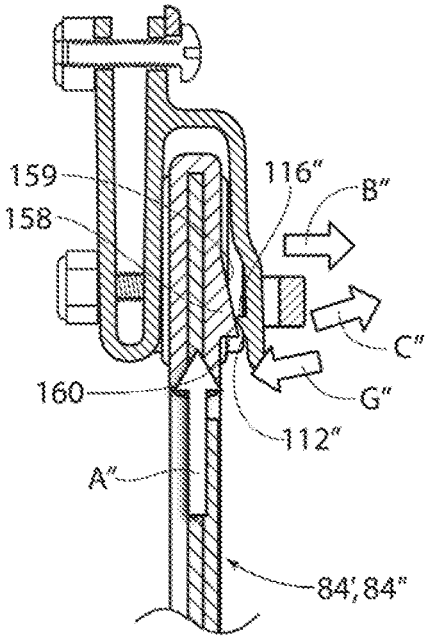
FIG. 31 is a method of operating the third embodiment of the card holding assembly of the present invention, illustrating insertion of the second embodiment of the card retaining sleeve and the collar into a fifth embodiment of the mounting holder of the present invention.

Action of the hinge mechanism 174 in retention of the sleeve/collar combination (84', 84") is best seen in the views of FIGS. 29 to 31. As illustrated in FIG. 31, the user may easily and quickly install the sleeve/collar combination (84', 84") in the sleeve holder 24"". As illustrated in FIG. 25, to engage the sleeve/collar combination (84', 84") in the sleeve holder 24"", the sleeve/collar combination (84', 84") is first inserted into the slot 96' of sleeve holder 24"". As the sleeve/collar combination (84', 84") is moved in the direction of arrow A", the ramped ledge surface 159 imparts pressure on the ramp portion 112' by the lever arm 151' and creates a upward force on the ramp portion 112" in the direction of arrow B". Continual motion of the sleeve/collar combination (84', 84") in the direction of the arrow A" causes continued movement of the lever arm 151' in the direction of arrow C". The ramped ledge surface 159 moves over and beyond the ramp portion 112" where the collar ledge 158 finally seats against the ramped surface lever back portion 116" to secure the sleeve/collar combination (84', 84") in the holder 24", reference direction arrow G" in FIG. 31 and reference FIG. 29.

The position of the sleeve/collar combination (84', 84") and holder 24" illustrated in FIG. 29 depicts the sleeve/collar combination (84', 84") securely positioned in the sleeve holder 24", with the hinge mechanism 174 locking the sleeve/collar combination (84', 84") in place, and the lever arm 151' resisting pullout in the direction of arrow F", reference FIG. 30, due to lever back portion 116" of the lever arm 151' engagement against opposite base surface 160 of the collar ledge 158.

Release of the sleeve/collar combination (84', 84") way be seen in the view of FIG. 30. As shown, the lever end 149' is advanced opposite the cavity 95' in the direction of arrow D". The ramp 112''' is thereby moved downward, the direction E', while also moving the lever back portion 116" to permit the release of the collar ledge 158. The action also permits removal of the sleeve/collar combination (84', 84") from the holder 24" in the direction of arrow F'.

It is observed at least one element of the first embodiment, of the card holding assembly 18 may be in cooperation with at least one element of the second embodiment of the card holding assembly 18'.

It is observed at least one element of the first embodiment of the card holding assembly 18 may be in cooperation with at least one element of the third embodiment of the card holding assembly 18'.

It is observed at least one element of the second embodiment of the card holding assembly 18' may be in cooperation with at least one element of the third embodiment of the card holding assembly 18".

An intended benefit of the card holding assembly of the present invention is to provide for a collar and mounting holder which reduces vibration of the card holding assembly.

An intended benefit of the card holding assembly of the present invention is to provide for a collar designed to reduce the transfer of vibration thru the card holding assembly.

An intended benefit of the card holding assembly of the present invention is to provide for a mounting holder designed to reduce the transfer of vibration thru the card holding assembly.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A card holder assembly for removable attachment to a vehicle comprising:

a card retaining sleeve having at least one closed edge;

a collar removably coupled with said card retaining sleeve; and a holder having at least one opening for receiving at least one of said card retaining sleeve and said collar.

2. The card holder assembly of claim 1, wherein said card retaining sleeve further comprising a back panel and a top edge, with said top edge having a laterally extending portion.

3. The card holder assembly of claim 2, wherein said collar is removably coupled with at least one of said laterally extending portion and said back panel.

4. The card holder assembly of claim 1, wherein said collar comprising two halves removably attached about said card retaining sleeve.

5. The card holder assembly of claim 1, wherein said at least one opening defining at least one post cavity and at least one central cavity.

6. The card holder assembly of claim 5, wherein said collar having at least one collar post slidably positionable in said at least one post cavity.

7. The card holder assembly of claim 1, further comprising said holder is mountable to said vehicle by at least one of at least one thru hole along a holder length and a mounting groove extendable at least substantially said holder length.

8. The card holder assembly of claim 1, wherein said collar having at least one substantially vertical rib in frictional communication with said holder.

9. The card holder assembly of claim 1, wherein said collar is in communication with said card retaining sleeve thru at least one of at least one screw, at least one snap, sonic welding, and as an over-mold.

10. An improved card holder assembly for removable attachment to a vehicle of the type having a card retaining sleeve with at least one closed edge, and in which a holder having at least one opening in at least close communication with said card retaining sleeve, wherein the improvement comprises:

a collar removably coupled with said card retaining sleeve; and at least one of said card retaining sleeve and said collar received by said at least one opening.

11. The improved card holder assembly of claim 10, wherein said card retaining sleeve comprising a back panel and a top edge, with said top edge having a laterally extending portion.

12. The improved card holder assembly of claim 11, wherein said collar is removably coupled with at least one of said laterally extending portion and said back panel.

13. The improved card holder assembly of claim 10, wherein said collar comprising two halves removably attached about said card retaining sleeve.

14. The improved card holder assembly of claim 10, wherein said at least one opening defining at least one post cavity and at least one central cavity.

15. The improved card holder assembly of claim 14, wherein said collar having at least one collar post slidably positionable in said at least one post cavity.

16. The improved card holder assembly of claim 10, further comprising said holder is mountable to said vehicle by at least one of at least one thru hole along a holder length and a mounting groove extendable at least substantially said holder length.

17. The improved card holder assembly of claim 10, wherein said collar having at least one substantially vertical rib in frictional communication with said holder.

18. A method of operating a card holder assembly for removable attachment to a vehicle comprising:

said card holder assembly comprising:

a card retaining sleeve having at least one closed edge;

a holder having at least one opening for receiving at least one of said card retaining sleeve and said collar removably coupled to said card retaining sleeve;

said holder having a locking mechanism for releasable engagement with at least one of said card retaining sleeve and said collar, actuating said locking mechanism; and releasably communicating said locking mechanism with at least one of said card retaining sleeve and said collar.

19. The method of operating a card holder assembly of claim 18, further comprising actuating a locking mechanism spring, wherein said spring is operable substantially orthogonal to said card retaining sleeve.

* * * * *